US009778002B2

(12) United States Patent
Burczynski et al.

(10) Patent No.: US 9,778,002 B2
(45) Date of Patent: Oct. 3, 2017

(54) SHOT CUP WAD

(71) Applicant: RA Brands, L.L.C., Madison, NC (US)

(72) Inventors: Thomas J. Burczynski, Montour Falls, NY (US); Jonathan W. Langenfeld, Cabot, AR (US)

(73) Assignee: RA Brands, L.L.C., Madison, NC (US)

( * ) Notice: Subject to any disclaimer, the term of this patent is extended or adjusted under 35 U.S.C. 154(b) by 30 days.

(21) Appl. No.: 14/570,369

(22) Filed: Dec. 15, 2014

(65) Prior Publication Data

US 2015/0176954 A1 Jun. 25, 2015

Related U.S. Application Data

(60) Provisional application No. 61/919,031, filed on Dec. 20, 2013.

(51) Int. Cl.
*F42B 7/04* (2006.01)
*F42B 7/08* (2006.01)

(52) U.S. Cl.
CPC ..... *F42B 7/08* (2013.01); *F42B 7/04* (2013.01); *F42B 7/043* (2013.01)

(58) Field of Classification Search
CPC ..... F42B 7/04; F42B 7/043; F42B 7/08
USPC ..... 102/448, 449, 450, 451, 453, 461, 532
See application file for complete search history.

(56) References Cited

U.S. PATENT DOCUMENTS 2,953,990 A * 9/1960 Miller ..... F42B 7/06 102/449
3,110,434 A 11/1963 Raymond et al.
3,186,058 A 6/1965 Mittelsteadt
3,234,877 A 2/1966 Herter
3,279,375 A 10/1966 Herter
3,299,813 A * 1/1967 Rickey ..... F42B 7/08 102/451
3,359,906 A 12/1967 Herter
3,368,489 A 2/1968 Herter
3,370,534 A 2/1968 Herter
3,590,740 A 7/1971 Herter
3,591,898 A 7/1971 Stenmo
(Continued)

FOREIGN PATENT DOCUMENTS

EP 0 671 598 9/1995

OTHER PUBLICATIONS

European Search Report dated Apr. 22, 2015 for EP 14198780.0.
(Continued)

*Primary Examiner* — James S Bergin
(74) *Attorney, Agent, or Firm* — Womble Carlyle Sandridge & Rice, LLP

(57) ABSTRACT

A wad or shot cup having a forward cylinder portion receiving a payload and a rear cylinder portion receiving a charge of propellant. One or more latent deceleration features can be formed in a surface of the sidewall extending along the rear cylinder portion. The latent deceleration features can be spaced apart from a rearward end of the shot cup and can be deployed to form deceleration petals after the shot cup is fired from a firearm. A series of longitudinal slits can be formed in the forward cylinder portion so that a portion of the sidewall expands radially adjacent the longitudinal slits after the shot cup is fired from a firearm for urging at least a portion of the payload to exit the forward cylinder portion.

41 Claims, 28 Drawing Sheets

(56) References Cited

U.S. PATENT DOCUMENTS

| | | | | |
|---|---|---|---|---|
| 3,614,929 | A | 10/1971 | Herter et al. | |
| 3,653,326 | A * | 4/1972 | Howsam | F42B 7/08 102/451 |
| 3,673,965 | A | 7/1972 | Herter | |
| 3,678,858 | A | 7/1972 | Herter et al. | |
| 3,727,557 | A | 4/1973 | Starcevich | |
| 3,752,434 | A | 8/1973 | Herter | |
| 3,808,974 | A | 5/1974 | Herter | |
| 3,812,784 | A | 5/1974 | Herter | |
| 3,835,783 | A | 9/1974 | Curran | |
| 3,974,775 | A | 8/1976 | Kerzman et al. | |
| 5,452,535 | A | 9/1995 | See et al. | |
| 5,644,100 | A | 7/1997 | Puckett et al. | |
| 5,874,689 | A | 2/1999 | Alkhatib | |
| 6,164,209 | A | 12/2000 | Best et al. | |
| 6,260,484 | B1 | 7/2001 | Billings | |
| 6,367,388 | B1 | 4/2002 | Billings | |
| 7,171,904 | B2 | 2/2007 | Diller | |
| 7,174,833 | B2 | 2/2007 | Diller | |
| 7,415,929 | B1 | 8/2008 | Faughn | |
| 7,707,942 | B1 | 5/2010 | Gardner | |
| 8,220,393 | B2 | 7/2012 | Schluckebier et al. | |
| 8,418,620 | B2 | 4/2013 | Frank | |
| 8,555,785 | B2 * | 10/2013 | Cross | F42B 7/08 102/451 |
| 9,046,328 | B2 * | 6/2015 | Nauman | F42B 7/04 |
| 2012/0067243 | A1 | 3/2012 | Frank | |
| 2013/0055917 | A1 | 3/2013 | Menefee | |
| 2017/0108318 | A1 * | 4/2017 | Moser | F42B 7/043 |

OTHER PUBLICATIONS

"Winchester Wads"; www.winchester.com; http://www.winchester.com/Products/components/wads-shot/winchester-wads/Pages/winchester-wads.aspx (Accessed Dec. 12, 2013).

"Great Gun/Load Combo for Gobblers"; www.shootingtimes.com; hppt://www.shootingtimes.com/2011/01/03/longgun_reviews_benellis_082907/ (Accessed Dec. 12, 2013).

"Federals Flightcontrol Wads"; www.wildfowlmag.com; http://www.wildfowlmag.com/tips_strategies_wf_smartwads_1209.html (Accessed Dec. 12, 2013).

"Questions about Federal LE23200"; www.shotgunworld.com; http://www.shotgunworld.com/bbs/viewtopic.php?f+7&t=213155(Accessed Dec. 12, 2013).

"Flitecontrol shotgun wadding for Federal tactical 00 buckshot 9-pellet"; www.weaponscache.com; http://www.weaponscache.com/forum/ammunition-reloading/6401-flitecontrol-shotgu.

* cited by examiner

SHOT CUP WAD

CROSS REFERENCE TO RELATED APPLICATIONS

The present Patent Application is a formalization of previously filed, U.S. Provisional Patent Application Ser. No. 61/919,031, filed Dec. 20, 2013, by the inventors named in the present Application. This Patent Application claims the benefit of the filing date of the United States Provisional Patent Application cited above according to the statutes and rules governing provisional patent applications, particularly 35 U.S.C. §119(e) and 37 C.F.R. §1.78(a)(3)-(4). The specification and drawings of the United States Provisional Patent Application referenced above are specifically incorporated herein by reference as if set forth in their entireties.

FIELD OF THE INVENTION

The present invention generally relates to shotshells with other applications related to ammunition products and/or systems for delivery/firing of a projectile. In particular, the present invention relates to improvements in shot cups and/or wads for shotshells, muzzle loading or specialty centerfire sabots and/or pusher wads, and other ammunition products and/or systems.

BACKGROUND OF THE INVENTION

Shotshells and/or other, similar cartridges typically include a tubular body with a primer at one end, a propellant powder to be ignited by the primer, and a payload such as a series of shot pellets or a slug, in front of the propellant powder. The shotshell can be received in a chamber of a firearm, which can be actuated for igniting the propellant powder via the primer. The propellant powder can produce high pressure gas that can propel the payload from the chamber and along the barrel of the firearm. Shotshells further can include a shotshell wad between the propellant powder and the payload for containing the payload as it moves down barrel after firing. Certain conventional shotshell wads can include a shot cup for containing at least a portion of the payload, and also can include a series of petals or split sections that flare outwardly after firing to slow the shotshell wad and provide separation between the projectiles, e.g. shot pellets, and the shotshell wad. Such shotshell wads typically rely on air pressure acting on the forward end of the wad to deploy the petals or split sections. However, such air pressure can have an adverse effect on the shot pattern since the incoming air pressure and/or flow can cause radial spreading of the forward petals and disperse shot pellets in a wider-than-desired pattern too quickly. Uneven deployment of the petals (e.g., due to the uneven air pressure within the shot cup of the shotshell wad as the air passes through the unevenly dispersed shot pellets in the shot cup) can cause the shotshell wad to veer or be directed away from the intended direction of the shot. This can affect the trajectory of some or all of the shot pellets and can inconsistently spread out and increase the width of the shot pattern, subsequently resulting in inconsistent and unpredictable placement of the shot pattern from shot to shot.

Accordingly, it can be seen that a need exists for a shotshell cartridge design that addresses the foregoing and other related and unrelated problems in the art.

SUMMARY OF THE INVENTION

Briefly described, the present invention generally relates to improvements in shot cups and/or wads for use with various types of ammunition, including shotshell, centerfire, and rimfire ammunition, muzzle loading sabots, and/or other types of projectile delivery/ammunition or firing systems. In one example embodiment, the invention can comprise a wad or shot cup having a body including a forward cylinder defining a chamber for receiving a payload, i.e., shot pellets or other multiple projectiles, and a rear cylinder defining a rearward chamber for receiving a charge of propellant, each cylinder section extending from an intermediate partition. In one embodiment, the rear cylinder can be in communication with a primer. One or more impressions (e.g., two, three or any suitable number) or weakened areas can be defined or formed in an interior or exterior surface of the rear cylinder. The impressions can be spaced apart about the circumference of the rear cylinder and can form petals after firing of the shotshell.

Upon firing, a primer blast is directed into the rear cylinder so as to ignite the propellant powder, which produces pressurized gas. The pressurized gas will expand within the rear cylinder so as to propel the wad and the payload received in the forward cylinder down a firearm barrel. Once the wad exits the muzzle end of the barrel, the pressurized gas acting on the rear cylinder can cause rupturing of the rear cylinder at the impressions to form a series of petals, which petals can flare outwardly (e.g., radially) from the rear cylinder in response to the pressure from the propellant gases. In one embodiment, heat from combustion of the propellant can aid in the rupture of the rear cylinder along the impressions for formation of the petals. The deployed petals can rapidly slow the wad to provide and/or facilitate a substantially rapid separation between the wad and the shot pellets, which exit the forward end of the forward cylinder. This can foster enhanced ability of the shot pellets to stay on target during and after release from the wad and can provide a tighter shot pattern since the shot payload remains in a generally cylindrical shape for a longer period of time and the separation is more likely to occur before instabilities develop in the wad after exiting the firearm barrel.

In another embodiment, an un-slit or substantially unperforated wad or shot cup for holding shot in a shotshell cartridge or other round of ammunition is disclosed. The shot cup can be formed with a one-piece or substantially unitary body structure that includes a first cylindrical forward portion for receiving shot pellets, and a shorter second cylindrical rear portion adjacent a charge of propellant. The forward portion and the rear portion can be joined at a common intermediate partition. The sidewall of the rear portion further can include one or more molded impressions within its interior. The shapes of the impressions can help form the contoured depressions or other features defining one or more spaced apart, unformed (latent) deceleration features wherein the greatest depth of each contoured depression forms a thin web of rupturable shot cup material. When the shotshell cartridge is fired, the cylindrical rear portion of the shot cup can be heated by hot propellant gases sufficient to soften and cause radially stretching of the web areas, weakening and preconditioning such web areas as the shot cup traverses a forcing cone area of the shotgun barrel. As the shot cup exits the muzzle of the shotgun barrel, the high pressure expanding gases can substantially instantly or otherwise rapidly rupture the contoured web areas, causing deceleration features to form in and subsequently deploy from the shot cup body in an outward radial direction. Sudden deployment of the deceleration features combined with redirected gas jets can help create a powerful deceleration impulse by way of increased air resistance. Such air resistance can cause the shot cup to become separated or strip away from the shot column in a substantially straight path or action that facilitates/causes a substantially dense and centered downrange pellet pattern of smaller or reduced diameter. After the shot cup is fired, the material at the mouth area of the cylindrical rear portion further can remain substantially undivided and intact.

These and various other advantages, features, and aspects of the exemplary embodiments will become apparent and more readily appreciated from the following detailed description of the embodiments taken in conjunction with the accompanying drawings, as follows.

Figure 1:
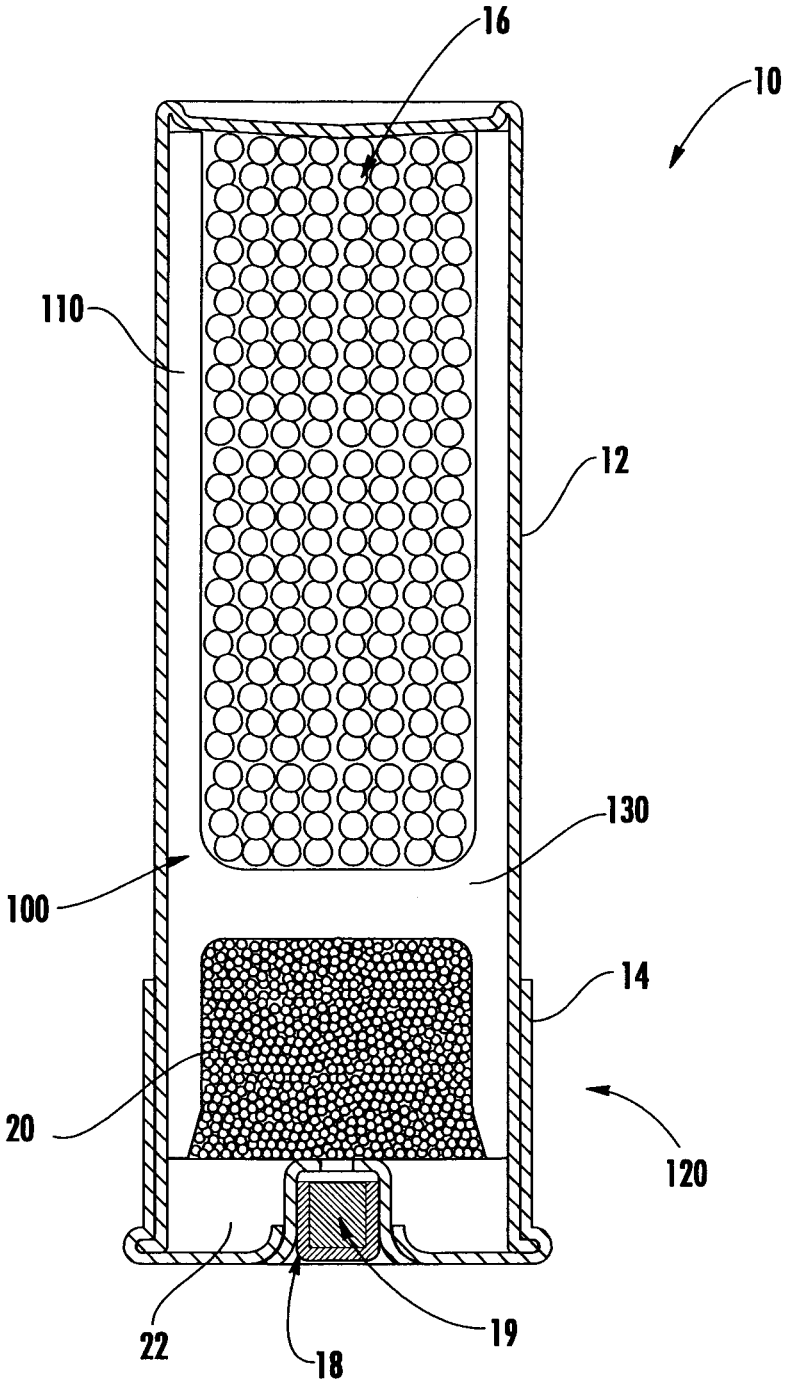
FIG. 1 is a schematic cross-sectional view of a round of ammunition including a shot cup or wad according to a first exemplary embodiment of the disclosure.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION OF THE EXEMPLARY EMBODIMENTS

The present invention is directed to improvements in the performance of ammunition, including small arms ammunition such as shotshells, rimfire/centerfire cartridges, as well as for muzzle loading sabots, and other types of ammunition and projectile firing or delivery systems. Accordingly, while the present invention is illustrated herein in various example embodiments including use in shotshells, it will be understood that the wad of the present invention further can be used with a variety of other types and calibers of ammunition. As shown schematically in FIG. 1, in one example embodiment, the present invention generally can comprise a shotshell, cartridge, or other, similar round of ammunition 10 having a shell or cartridge body 12, a base or head portion 14, and a wad or shot cup 100.

The wad or shot cup 100 is configured to fit/be received within the shell body 12 and can include a first or forward cylinder portion 110 having an open-ended chamber, recess or cavity 114 defined therein for receiving shot pellets 16 or other suitable payload, a similar rear portion 120, and an intermediate partition 130 between the forward and rear portions. The shot cup 100 can be alternatively configured without departing from the disclosure. A rearward end of the shell body 12 further generally is disposed/received within the base 14, wherein a base wad 22 is disposed between a rearward end of the shot cup 100 and a rearward wall of the base 14. In one embodiment, the base wad 22 comprises a fiber or polymer material and can be an independent component that remains fixed within the shell body 12 after the round of ammunition 10 is fired. In the illustrated embodiment, a primer cup 18 can contain a priming compound 19 and can be received within the base wad 22. A propellant charge 20 can be at least partially contained in the shell body 12 between the rearward end of the base 14 and the intermediate partition 130, the propellant charge generally being received within a rear chamber or cavity 121 defined in the rear cylinder portion 120 of the shot cup 100.

As shown in FIG. 1, the base wad 22 can help retain the propellant charge 20 in the interior chamber 121. The round of ammunition 10, including the shell body 12, the base 14, the primer cup 18, the base wad 22, and/or the propellant charge 20 can be otherwise configured and/or arranged without departing from the disclosure. In addition, any suitable type of propellant powders and/or priming compounds can be used.

Figure 2:
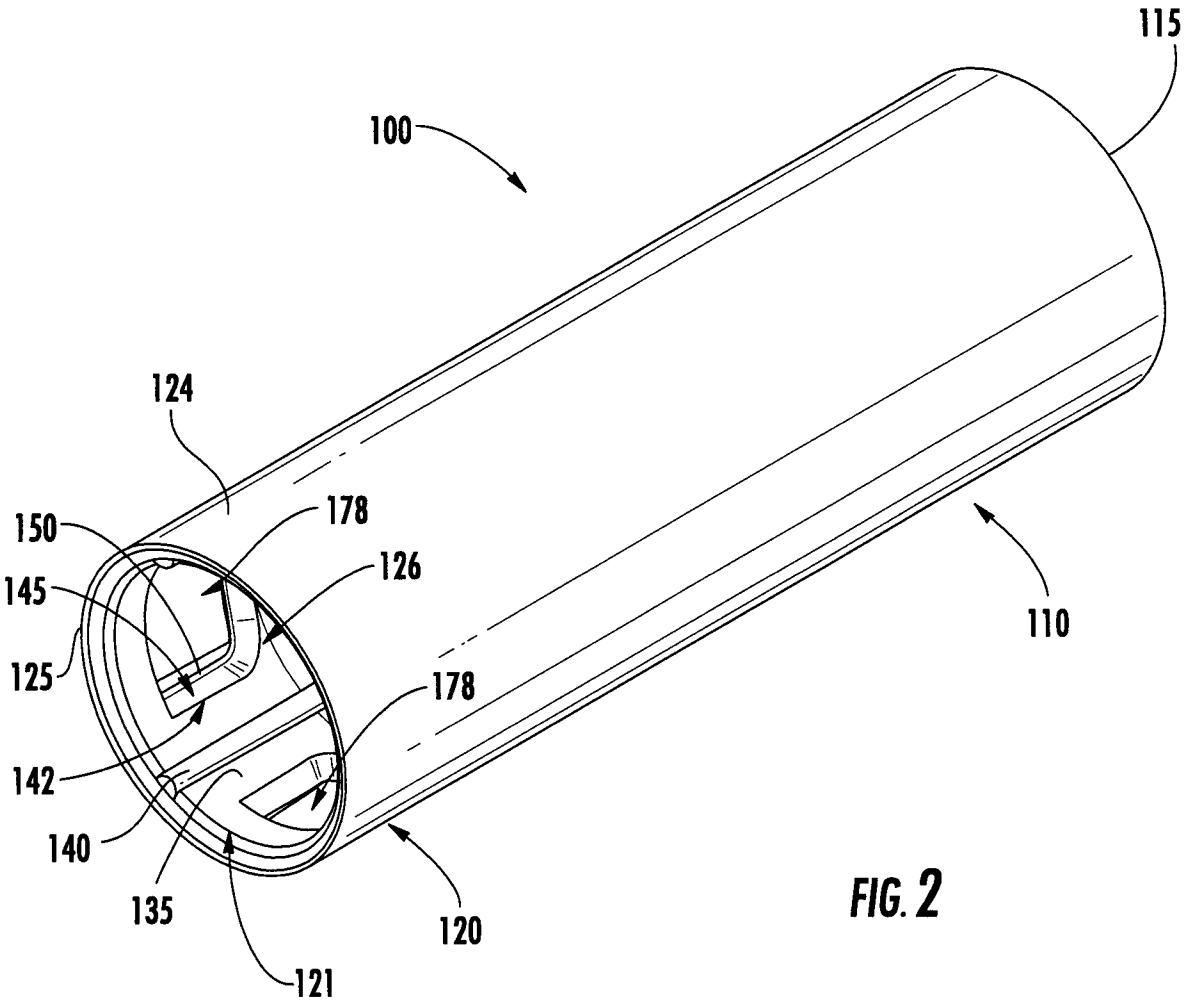
FIG. 2 is an isometric view of the shot cup of FIG. 1 according to the first exemplary embodiment of the disclosure.
Figure 3:
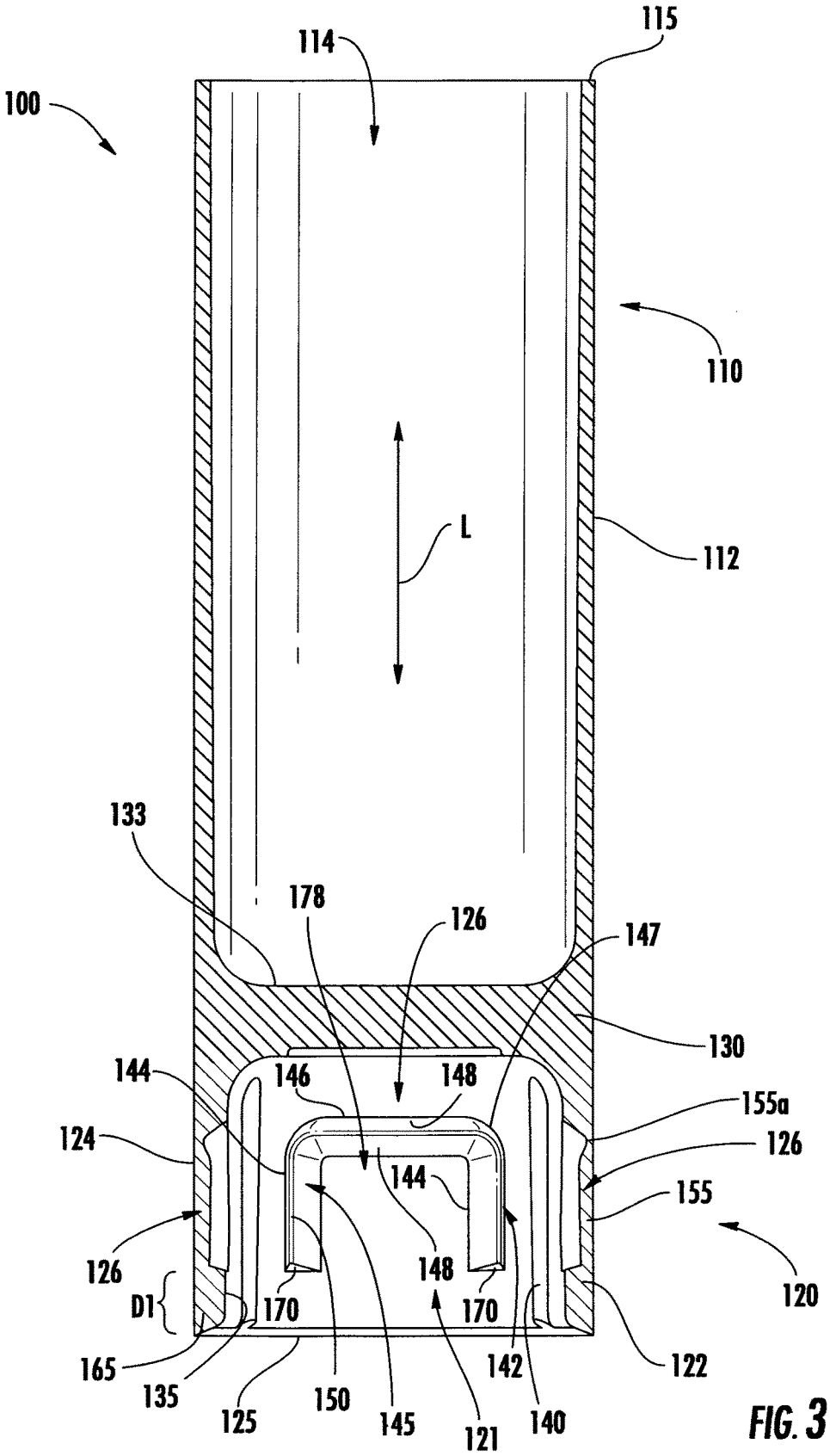
FIGS. 3 and 4 are longitudinal cross-sectional views of the shot cup of FIG. 2.
Figure 4:
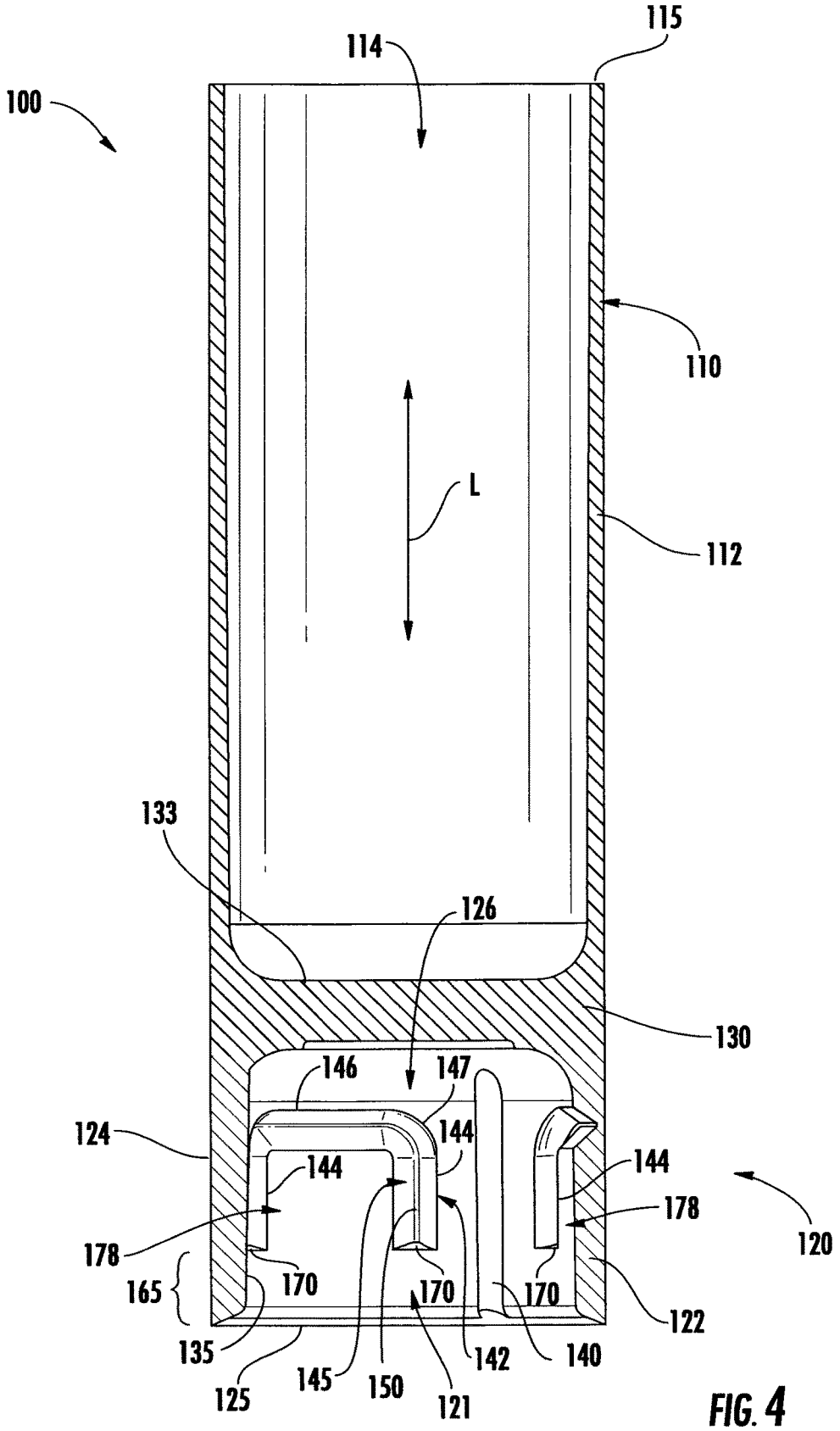
Figure 6:
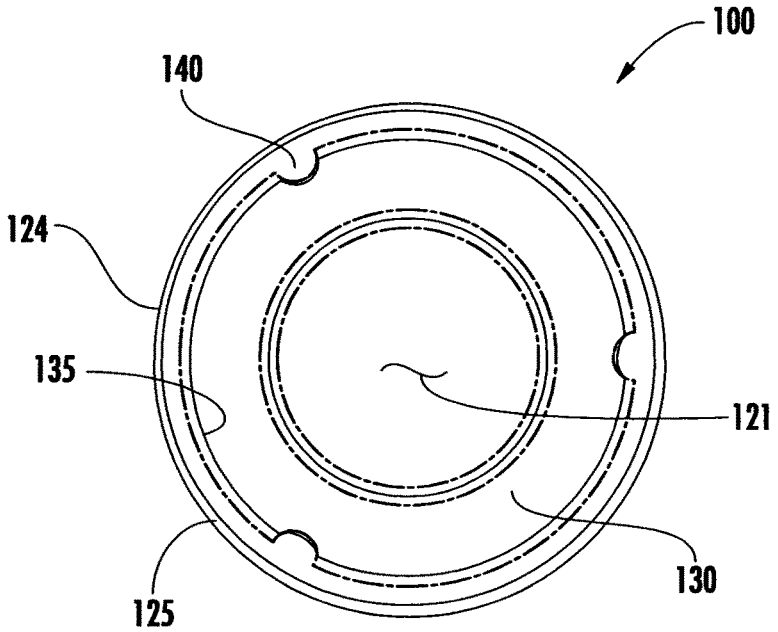
FIG. 6 is an end view of the shot cup of FIG. 2.

As shown in FIGS. 2-4, the shot cup 100 can be generally cylindrically shaped, though other configurations also could be used, with a longitudinal axis L, and the forward cylinder portion 110 can have a sidewall 112 extending from a forwardmost portion 133 of the intermediate partition 130 to the forward end 115 of the shot cup 100. Accordingly, as shown in FIG. 1, the sidewall 112 can define the forward interior chamber 114 that receives the payload (e.g., pellets 16). In one embodiment, the sidewall 112 of the forward portion 110 is substantially solid and uninterrupted in that it generally has no cuts, slits, slots, incisions, scores, creases, petals, or the like such that this forward cylinder portion can be maintained as a substantially solid structure during and after firing of the round of ammunition 10. The forward portion 110, including the sidewall 112 and the forward end 115, further could be otherwise configured without departing from the disclosure.

In the illustrated embodiment, as generally shown in FIGS. 2-4, the rear portion 120 can have a sidewall 122 extending rearwardly from the intermediate partition 130 to a rearward end 125 of the rear portion 120. In one embodiment, the rearward end 125 can also form a rearward end or edge of the shot cup 100. The sidewall 122 at least partially defines the open-ended rearward interior chamber 121 that receives at least a portion of the propellant charge 20 (FIG. 1). As further illustrated in FIGS. 2-4, the exterior surface 124 of the sidewall 122 of the rear portion 120 generally can be formed as a substantially smooth and uninterrupted surface, free of cuts, slits, slots, incisions, scores, creases, cut-through petals or the like, at least prior to firing of the round of ammunition 10. The rearward end 125 of the shot cup further can define a substantially solid and uninterrupted rim or base of the shot cup. The rearward portion 120, including the exterior surface 124, the sidewall 122, and the rearward end 125, could be otherwise configured and/or arranged without departing from the disclosure.

Figure 7:
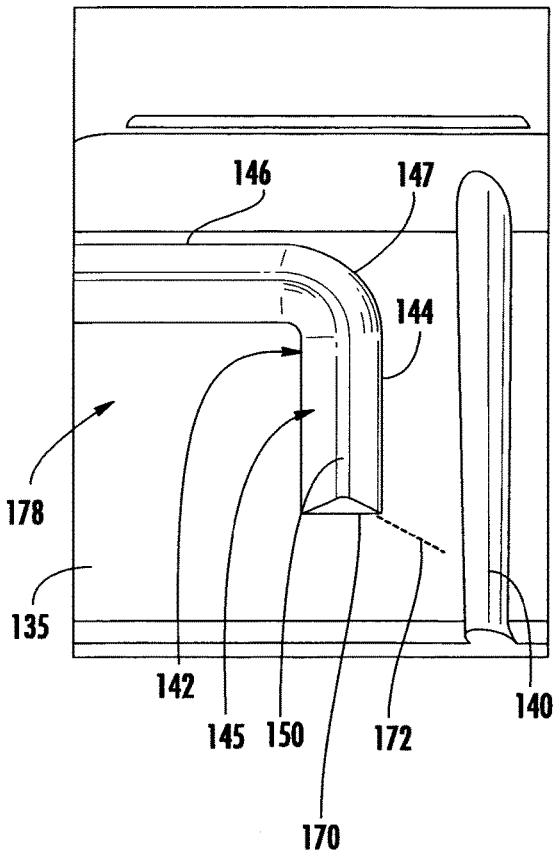
FIG. 7 is a detail view of an interior surface of the shot cup of FIG. 2.

In the illustrated embodiment, the shot cup 100 can include one or more latent deceleration features 126 designed to help form petals, fins, or similarly outwardly flaring elements after firing. Each of the deceleration features 126 can include a shaped or defined impression 142 disposed in an interior surface 135 of the sidewall 122 of the rear cylinder portion 120 of the shot cup 100. The shaped impressions 142 can include contoured depressions 145 or thinned/weakened areas formed in the interior surface 135, extending partially into the thickness of the sidewall 122 without extending therethrough and to the exterior surface 124 of the sidewall 122. As shown in FIG. 3, the shaped impressions 142 generally can be substantially L- or U-shaped to enable formation of generally rectangular petals after firing of the round of ammunition 10. In one embodiment, the shaped impressions 142 can have a pair of legs 144 connected by a cross segment 146, and additionally, the legs 144 can be connected to the cross segment 146 along respective curved portions 147 (FIGS. 3 and 4). The cross segment 146 generally can extend along or about the circumference of the sidewall 122, generally oriented transverse to the longitudinal axis L of the shot cup 100. As shown in FIGS. 3, 4, and 7, one or both of the legs 144 generally can be perpendicular to the cross segment 146, and can extend rearwardly in a direction generally parallel to the longitudinal axis L of the shot cup.

Figure 5:
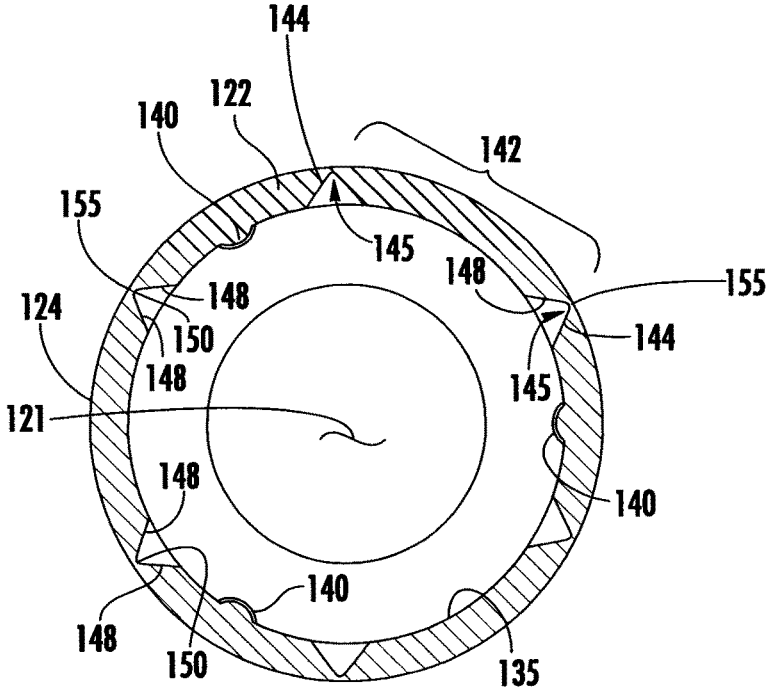
FIG. 5 is a transverse cross-sectional view of a rear cylindrical portion of the shot cup of FIG. 2.

As shown in FIG. 5, in one embodiment, the cross-sectional shape of the contoured depressions 145 can comprise generally oblique walls 148, with a base line 150, for example forming a substantially U- or V-shaped cross-section. The base line 150 of each contoured depression 145 can be recessed from the interior surface 135 (e.g., by the walls 148) and can be spaced apart from the exterior surface 124 of the rear portion to define a thin web 155 of material between the base line 150 and the exterior surface 124. In one example embodiment, the thickness of each web 155 can be approximately 0.005 inch to approximately 0.060 inch. It will, however, be understood that in further alternative embodiments, the web 155 can have any suitable thickness.

The base lines 150 of the respective contoured depressions 145 constitute respective low points along the contoured depressions 145, with relatively thin webs 155 of rupturable shot cup material within the sidewall 122. In the illustrated embodiment, each of the base lines 150 can have a width extending between two spaced apart corners formed where the base line 150 meets the respective walls 148 of the contoured depressions 145 (FIGS. 3-5). Alternatively, the base line 150 of each contoured depression 145 generally can be a vertex formed where the respective walls 148 meet in the contoured depression.

In one embodiment, the depth of the base lines 150 in the sidewall 122 can be substantially uniform along their respective contoured depression 145. However, the depth of the base lines 150 also can vary, which thus can, in turn, create variances in the thickness of their respective webs 155 relative to the depth of the base lines 150. For example, as shown in FIG. 3, the cross segment 146 of each of the contoured depressions 145 can have a greater depth in the sidewall 122 than the legs 144 in one embodiment. Additionally, in the illustrated embodiment, the contoured depression 145 does not pass through the exterior surface 124 of sidewall 122 along the extent of the contoured depression (e.g., the depth of the contoured depression 145 is less than the thickness of the sidewall 122 from the interior surface 135 to the exterior surface 124). In an alternative embodiment, the cross segment 146 and the legs 144 of the contoured depressions 145 can have any suitable depth in the sidewall 122.

In one embodiment, the greater depth of the cross segment 146 can result in formation of a thinner web **155*a* between the base line 150 along the cross segment 146 and the exterior surface 124 of the rear portion 120 (FIGS. 3 and 4). The thinner web 155*a* at the forward portion of the respective shaped impression 142 can help initiate the petal-forming/tearing process (e.g., tearing of the webs 155*a*, 155 along the base line 150) in a more precise, uniform, and repeatable manner, regardless of ambient temperature, than if the web 155 has a uniform thickness along its length. In an alternative embodiment, each of the shaped impressions 142 additionally can comprise a substantially consistent and gradually diminishing depth starting at the cross segment 146 and terminating at the ends 170 of the legs 144, and the web 155** can follow a correspondingly tapered geometry.

As shown in FIG. 3, the shaped impressions 142 generally can be spaced apart from the rearward end 125 of the shot cup 100 by a distance D1. Accordingly, in one embodiment, a region 165 of the rear portion 120 can be free of weakening features (e.g., the shaped impressions 142) so that the region 165 can remain substantially uninterrupted and/or undivided during and after firing of the round of ammunition 10.

As shown in FIG. 7, the ends 170 of the legs 144 can be arranged substantially perpendicular to the longitudinal axis L of the shot cup 100, and a stress riser 172 can extend from the end 170 of each leg 144 to help redirect tearing forces in the sidewall 122 during and/or after deployment of the respective deceleration features 126. The stress riser 172 can be a depression (e.g., an extension of the respective contoured depression 142) or any other suitable feature extending, for example, as indicated schematically by a dotted line extending at an oblique angle in FIG. 7. In one embodiment, the stress risers can be directed generally toward a respective rib 140. In alternative embodiments, the directional orientation and/or shape of such a stress riser can be otherwise configured and can take any suitable form. For example, stress riser 172 can be disposed downwardly towards the rearward end 125 of the shot cup 100, upwardly towards the front 115 of the shot cup 100, laterally outward into the space between the respective shaped impressions 142, and/or laterally inward, terminating within the respective deceleration feature 126. In another example, each of the stress risers 172 can comprise a forwardly curving geometry. The ends 170 of the legs 144 and/or the stress risers 172 could be omitted or could be otherwise configured and/or arranged without departing from the disclosure.

Figure 8:
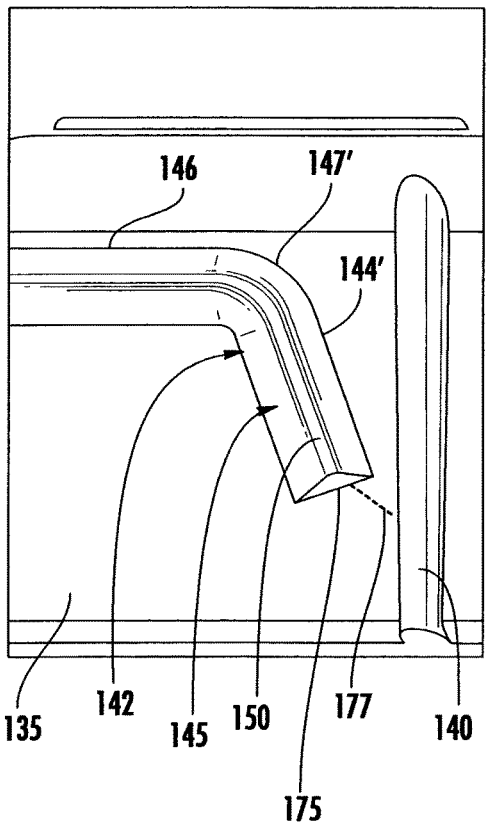
FIG. 8 is a detail view of an interior surface of the shot cup according to an alternative embodiment.

In an alternative embodiment shown in FIG. 8, one or both of the legs 144' of a shaped impression 142' could be formed at an oblique angle with respect to the cross segment 146, such as for forming a generally trapezoid-shaped petal, wherein the forward portion of the shaped impression is narrower than its rearward portion. In one embodiment, the trapezoid shape can help form a petal with an increased surface area. The increased surface area can help create a quicker and even more pronounced deceleration impulse as the deceleration features/petals are formed in the shot cup and deploy in response to gas pressure generated after the round of ammunition 10 is fired and the shot cup 100 proceeds along and exits the muzzle of the firearm barrel. A stress riser 172' can extend from each of the ends 170' of the respective legs 144' similar to the stress riser 172 in FIG. 7. The stress riser 172' is shown schematically by a dotted line extending at an oblique angle in FIG. 8. In one embodiment, the stress risers 172' can extend from each end 170' generally toward a respective rib 140. In a further alternative embodiment, the trapezoid shape of the shaped impression 142' in FIG. 8 could be inverted, such that the front portion of the trapezoid would be wider than the rear portion of the resultant deceleration feature/petal. This arrangement can help to allow a more rapid petal deployment during formation; for example when a low chamber pressure shotshell cartridge is used.

The height and width of the contoured depressions 145 (FIGS. 2-5 and 7), and ultimately the deceleration features or petals created therefrom (e.g., FIGS. 9 and 10), can vary depending on cartridge size and application. In the illustrated embodiment, the spacing between the legs 144 of a contoured depression 145 can be greater than the spacing between the cross segment 146 and the ends 170 of the legs 144. This aspect ratio can help reduce the longitudinal length of the rear portion 120 so that the forward portion 110 can be as long as possible. This arrangement also can enable greater capacity within the forward portion 110 so that it can receive a larger payload, e.g., a greater number of shot pellets 16. The heights, the widths, and/or the aspect ratios of the contoured depressions 145 could be otherwise configured and/or arranged without departing from the disclosure.

The latent deceleration features 126 can include any suitable number of shaped impressions 142 arranged in the rear portion 120. For example, the petal features 126 could include two shaped impressions disposed opposite one another in the rear portion 120, three shaped impressions substantially evenly spaced along the circumference of the rear portion 120 (FIGS. 2-5), four shaped impressions, twelve shaped impressions, etc. In an alternative embodiment, the shaped impressions additionally could be arranged in two or more rows that are spaced along the longitudinal axis L in the rear portion 120. The shaped impressions 142 could be otherwise configured and/or arranged without departing from the disclosure.

As additionally shown in the illustrated embodiment, the rear portion 120 of the shot cup 100 also can include one or more reinforcement members or ribs 140 for reinforcing (e.g., stiffening) the sidewall 122 between the deceleration features. The ribs 140 can extend inwardly from the interior surface 135 of the sidewall 122 and can extend generally parallel to the longitudinal axis L of the shot cup 100 (FIGS. 3-5). While three ribs 140 are shown spaced along the circumference of the sidewall 122 between the respective shaped impressions 142, any suitable number of ribs could be included. In one embodiment, the rear portion 120 can be reinforced by including one or more ribs 140 and/or by increasing the thickness of the sidewall 122 along the rear portion 120. The ribs 140 can help strengthen the sidewall 122 without requiring as much material as would be used by simply increasing the thickness of the sidewall 122 in the rear portion 120 of the shot cup 100. The ribs 140 could be otherwise configured and/or arranged without departing from the disclosure.

In the illustrated embodiment, the outline or profile formed by each of the base lines 150 of the contoured depressions 145 and the attendant webs 155 associated therewith generally defines at least a portion of the boundary of a latent (e.g., potential) deceleration feature/petal area 178 (FIGS. 2-4 and 7). Accordingly, fully formed petals 180 (FIGS. 9 and 10) are not formed in the shot cup 100 prior to firing the round of ammunition 10 in the illustrated embodiment. Instead, the deceleration features 126 have the potential to become a petal when acted upon by gas pressure due to combustion of the propellant 20 and/or the priming compound 19. The gas pressure can cause formation of the petals by causing an at least partially tearing or otherwise rupturing or separating of the webs 155 along the base lines 150 of the contoured depressions 145. The gas pressure in the interior chamber 121 of the rear cylinder portion 120 then can force the deceleration features 126 outwardly from the sidewall 122 to form and deploy respective petals 180 as the shot cup 100 exits the muzzle end of the barrel (not shown) after firing of the round of ammunition 10. Alternatively, the petals 180 could be deployed after exiting the muzzle end of the barrel.

Figure 9:
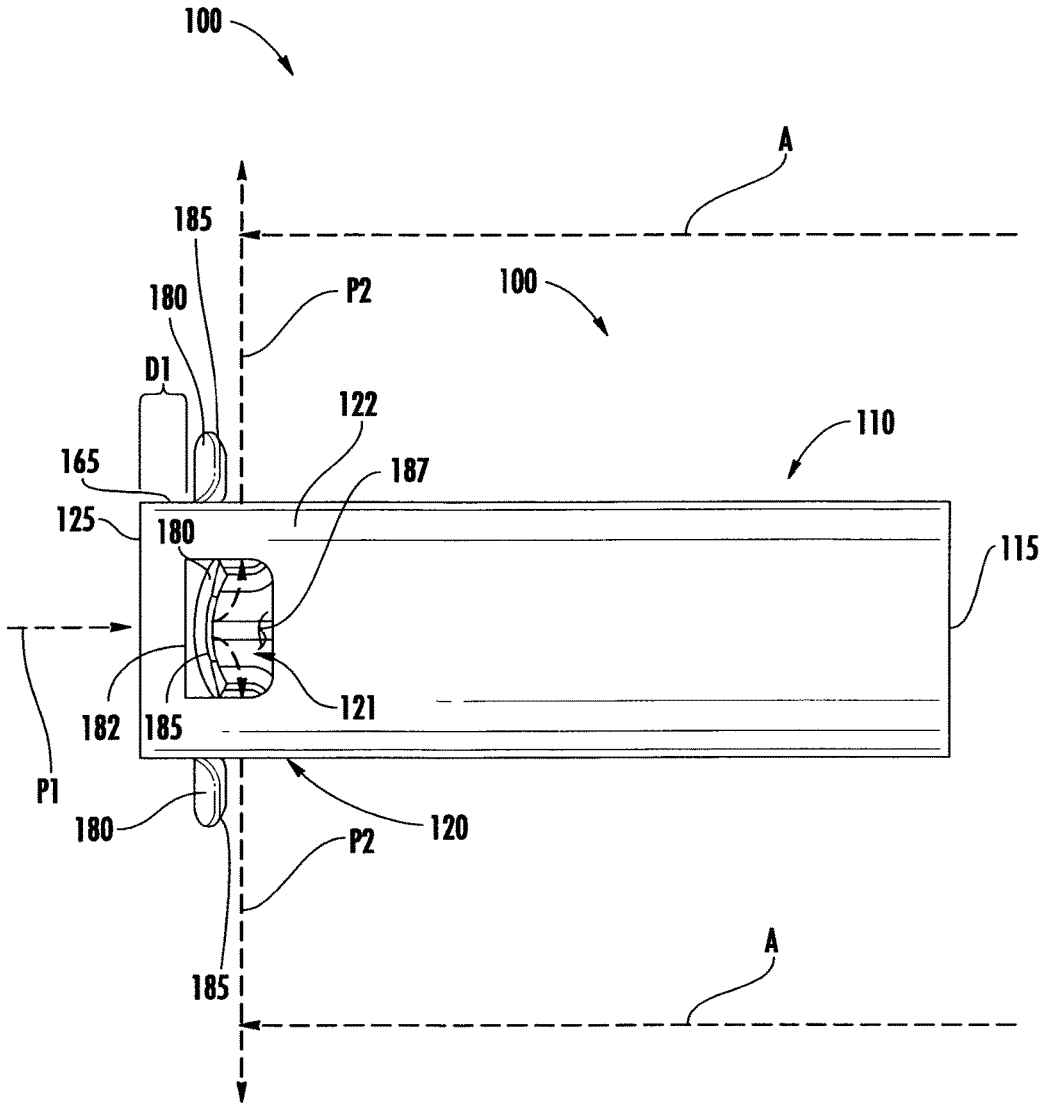
FIGS. 9 and 10 are side views of the shot cup of FIG. 2 with deceleration petals deployed according to the first exemplary embodiment of the disclosure.
Figure 10:
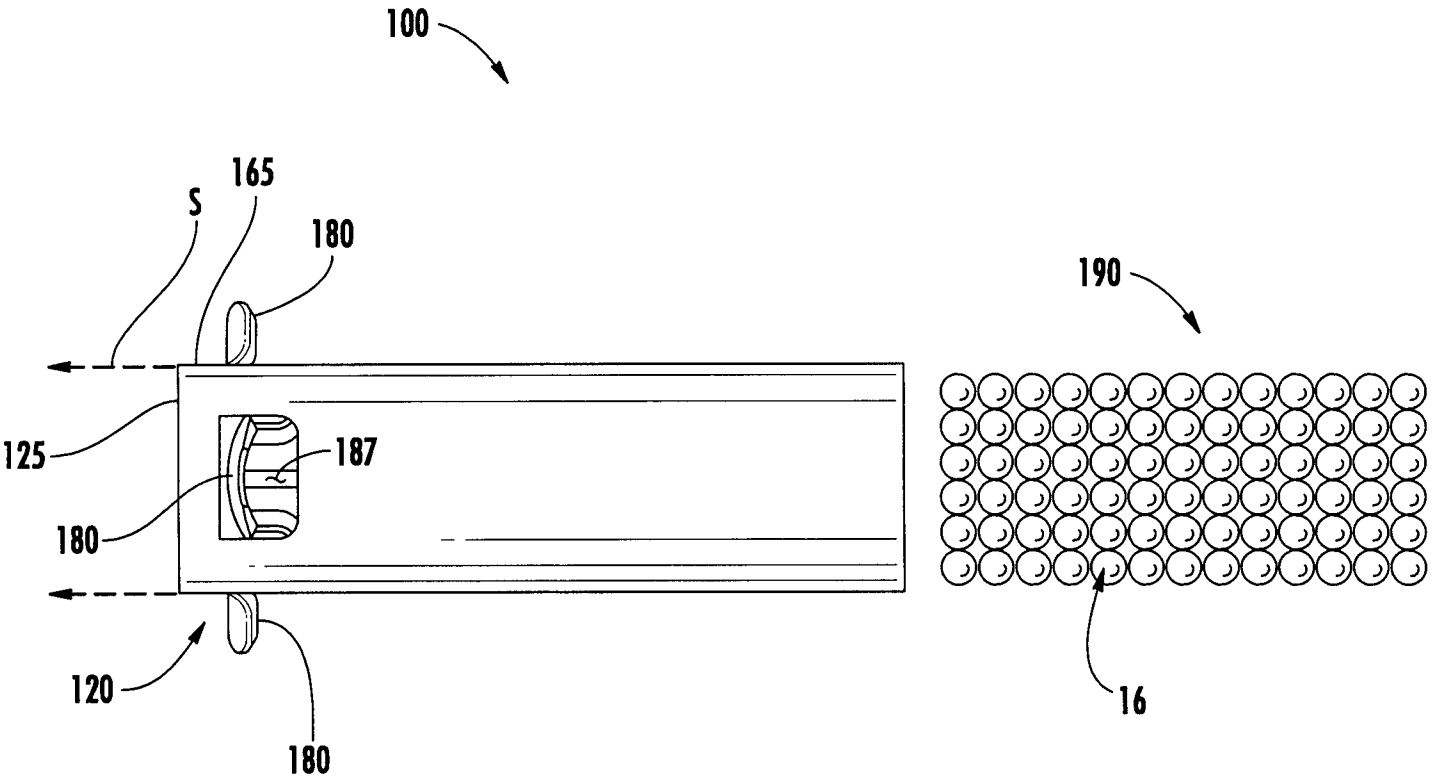

When deployed, each of the petals 180 can fold along a portion of the sidewall 122 extending between the ends 170 of the legs 144 of the respective contoured depressions 145 as indicated in FIGS. 9 and 10. Since the ends 170 of the petals and the folded portions of the sidewall 122 are spaced apart from the rearward end 125 of the shot cup 100 (e.g., by the distance D1), the band of material 165 extending from the rearward end 125 can remain substantially solid and uninterrupted even after deployment of the petals 180. Accordingly, both the rearward end 125 of the rear portion 120 and the solid band of uninterrupted material 165 can remain intact even in flight after the round of ammunition 10 is fired and the shot cup 100 exits the muzzle of the barrel of the firearm (not shown) to provide support to the deceleration features/petals as they deploy and encounter air pressure/resistance to facilitate the rapid deceleration of the shot cup 100 and separation of the shot cup 100 from the payload (e.g., pellets 16). The shapes of the contoured depressions 145 can be rectangular, rectangular with curved portions 147 (e.g., FIG. 7), trapezoidal, or trapezoidal with curved portions 147' (e.g., FIG. 8). Alternatively, the contoured depressions 145 can comprise any suitable shape.

In the illustrated embodiment, as indicated in FIGS. 9 and 10, when the round of ammunition 10 is fired (e.g., during a firing operation of a shotgun, not shown), the propellant 20 can burn to produce hot, expanding gas that can accelerate the shot cup 100. Accordingly, the shot cup 100 can be forced out of the shell body 12 and along the barrel of the shotgun (not shown). In addition, the entire rear portion 120 of the shot cup 100 can be heated by the hot gas created by burning the propellant 20. The heating of the rear portion 120 can soften and radially stretch the web areas 155*a* and 155, weakening and preconditioning them as the shot cup 100 passes through a wider forcing cone area of a shotgun barrel (not shown). In one embodiment, as the rear portion 120 of the shot cup 100 exits the muzzle of the shotgun barrel, the shot cup 100 is no longer confined by the barrel, and the high pressure expanding gas substantially rapidly ruptures the web areas 155*a* and 155 lying adjacent the base lines 150 of the respective contoured depressions 145. Alternatively, the high pressure expanding gas can rupture the web areas 155*a* and 155 after the rear portion 120 of the shot cup 100 exits the muzzle of the barrel. Accordingly, the deceleration petals 180 can be formed via a tearing action from front to back (e.g., along the cross segment 146 and then the legs 144 of each contoured depression 145) and can be deployed in an outward radial direction at the same time or at nearly the same time (FIGS. 9 and 10).

As further shown in FIGS. 9 and 10, the deceleration petals 180 (e.g., gas-formed petals) can have a relatively smooth edge 185 and can form openings 187 in the sidewall 122. The deceleration petals 180 could be otherwise configured and/or arranged without departing from the disclosure.

FIG. 9 shows the axial direction of the high pressure expanding propulsion gases P1, upon initiation, schematically shown by the right-facing broken arrow entering the interior chamber 121 of the rear portion 120 of the shot cup 100. After the shot cup 100 exits the muzzle end of the barrel of the firearm, the high pressure expanding gas P1 can press the latent petals 178 outwardly from the sidewall 122 of the rear portion 120. Accordingly, the deceleration petals 180 can be formed from the latent petals 178 under the pressure of the gas P1 exerted on the sidewall 122 and can be deployed by folding along a portion 182 of the sidewall 122 extending between the ends 170 of the legs 144 of the contoured depressions 145. At least a portion of the petals 180 can extend generally perpendicular to the longitudinal axis L of the shot cup 100 to encounter air resistance and help slow the shot cup 100. The generally even spacing of the petals 180 can help avoid uneven forces on the shot cup 100 due to air resistance and help avoid pivoting of the shot cup 100, which can affect the trajectory of the pellets 16 and/or increase the size of the shot pattern of the pellets. The petals 180 could be otherwise formed without departing from the disclosure.

The propulsion gases can be redirected in the interior chamber 121 in respective generally perpendicular routes. Accordingly, gas jets P2, schematically shown by transverse broken arrows in FIG. 9, can exit the interior chamber 121 through the openings 187 in the sidewall 122. The gas jets P2 also can help decelerate the shot cup 100. In one embodiment, the initiating gas pressure P1 can be active inside the rear portion 120 of the shot cup 100 for several microseconds after the shot cup 100 has exited the muzzle of the firearm barrel (not shown). The redirected gas jets P2, exiting the interior 121 of the rear portion 120 through the openings 187, can be sustained as long as the initiating gas pressure P1 is active. In essence the redirected gas jets P2 become "virtual petals" of great length relative to the petals 180. The virtual petals of the gas jets P2 can be viscously attached to and move forward with the shot cup 100 for several microseconds. When the redirected gas jets P2 meet the oppositional resistance offered by atmospheric air (designated by arrows A), they can assist the petals 180 in decelerating the shot cup 100 and stripping the shot cup 100 away from the shot column 190 (as schematically shown in FIG. 10). In effect, the sudden deployment of the petals 180 in combination with the redirected gas jets P2 creates a powerful deceleration impulse by way of increased air resistance which causes the shot cup 100 to strip away from the shot column 190 in a relatively straight path. This can help form a dense and centered downrange pellet pattern of a relatively small diameter.

FIG. 10 schematically shows the shot cup 100 with petals 180 deployed after the shot cup or wad has exited the muzzle of the barrel of the firearm and after it has been quickly stripped away from the shot column 190, which is comprised of the pellets 16. Generally, the faster the shot cup 100 is stripped away from the shot column 190, the rounder and more centered the downrange pellet pattern will be. Since, in one embodiment, the shot cup 100 is quickly decelerated in a rearward direction while minimizing transverse motion of the shot cup 100, the shot column 190 remains in a relatively tighter cluster having a small diameter for a longer period of time in flight before the pellets begin to spread out radially when compared to shot cups with deceleration features formed in the forward portion in which pellets can become ensnared. The direction in which the shot cup 100 is stripped away from the shot column 190 is shown by left-facing broken arrows S.

Figure 11:
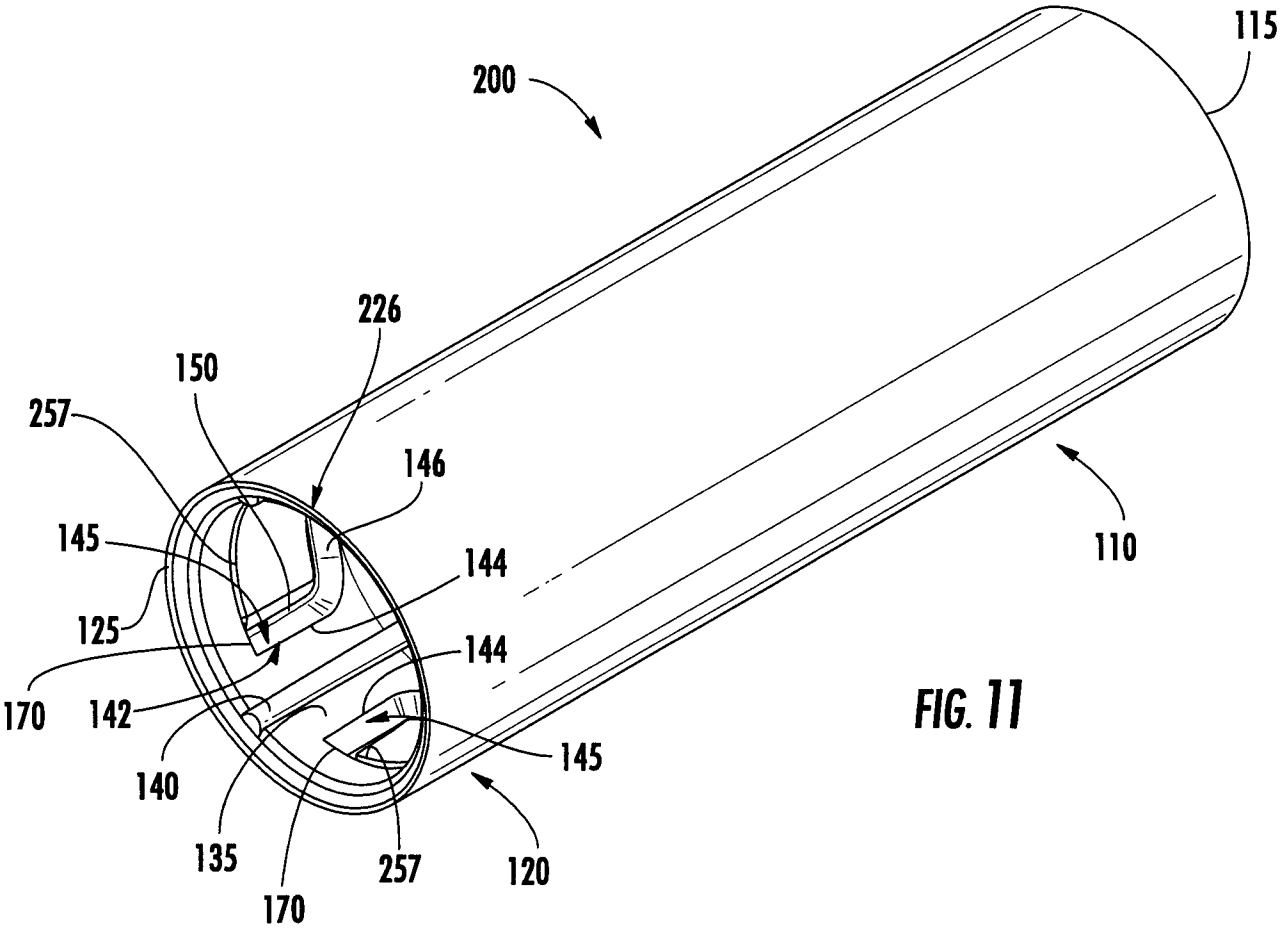
FIG. 11 is an isometric view of a shot cup according to a second exemplary embodiment of the disclosure.
Figure 12:
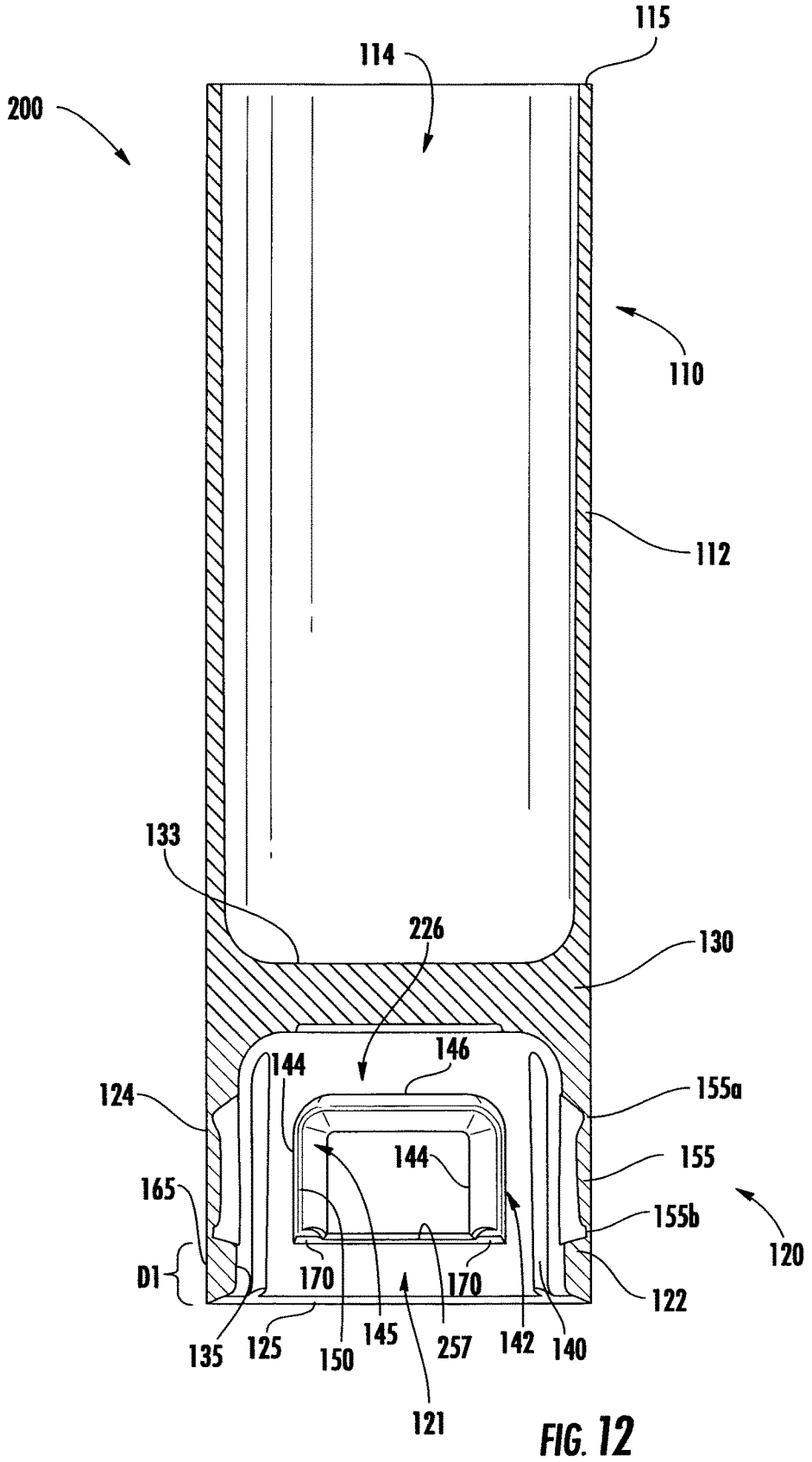
FIG. 12 is a longitudinal cross-sectional view of the shot cup of FIG. 11.
Figure 13:
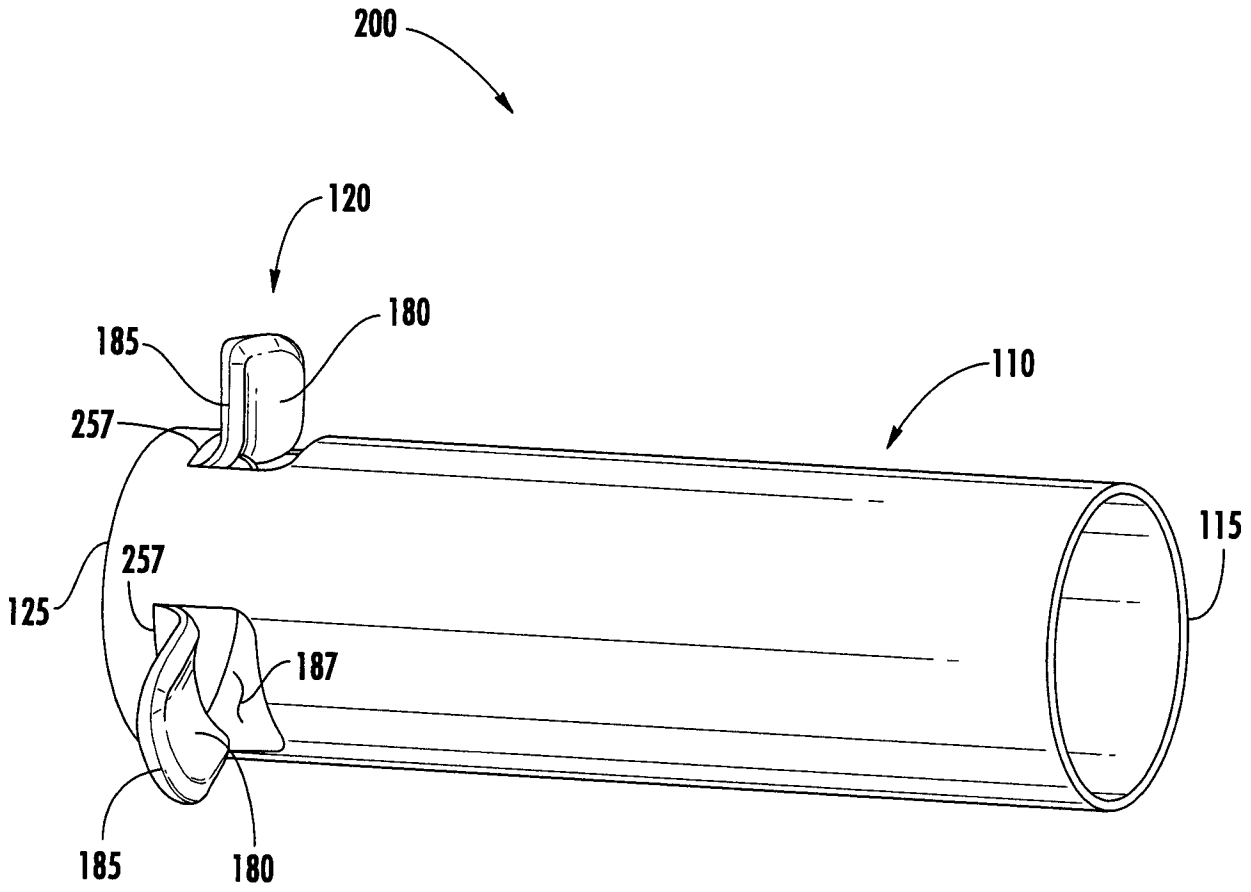
FIG. 13 is an isometric view of the shot cup of FIG. 11 with deceleration petals deployed according to the second exemplary embodiment of the disclosure.

FIGS. 11-13 are views of a wad or shot cup 200 according to a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIGS. 11 and 12, the latent deceleration features 226 of the shot cup 200 can include an added feature that takes the form of a living hinge depression 257 associated with each of the shaped impressions 142. The living hinge depression 257 comprises an added lateral indention on the interior surface 135 of the sidewall 122 of the rear portion 120 and can extend between the ends 170 of the legs 144 at the rearmost portion of each of the contoured depressions 145. The living hinge depression 257 can subsequently form an additional web area 155*b* (FIG. 12), which can be thinner, thicker, or the same thickness as that of the forward portion of the web 155*a*. In one embodiment, the living hinge depression 257 can form a closed rectangle or modified rectangle versus the inverted "U" shape having an open rearward area as shown in the first embodiment. In the illustrated embodiment, the living hinge depressions 257 can assist in the deployment of respective gas-formed deceleration petals 180 (FIG. 13) when the shot cup 100 is fired from shotshells that develop relatively low chamber pressure, for example. In short, the living hinge depression 257 can help the gas-formed petal 180 to bend rearwardly more easily. The contoured depressions 145 and/or the living hinge depression 257 of the second embodiment can comprise any suitable shape. The shot cup 200, including the latent deceleration features 226 and/or the living hinge depressions 257, could be otherwise configured and/or arranged without departing from the disclosure.

The shot cup 100 of the illustrated embodiments can provide a much quicker, more powerful stripping action through the combination of (1) active gas pressure plus (2) air pressure relative to prior art shot cups or wads which depend solely on air pressure alone. In addition, the further rearward the petals 180 are located on the shot cup 100, the longer the shot cup 100 generally can maintain alignment with the bore of the firearm and the straighter the shot cup will travel towards the target prior to all shot pellets 16 being released.

FIGS. 14 and 15A-15C are views of a wad or shot cup 300 according to a third embodiment of the disclosure. The third embodiment can have a structure that is generally similar to the first embodiment except for variations noted and variations that will be apparent to one of ordinary skill in the art. Accordingly, similar or identical features of the embodiments have been given like or similar reference numbers. As shown in FIGS. 14 and 15A-15C, the shot cup 300 does not include the reinforcement members or ribs 140 of the shot cup 100 of the first embodiment (FIGS. 2-6). Alternatively, the shot cup 300 could incorporate one or more reinforcement ribs and/or other reinforcing features.

Figure 14:
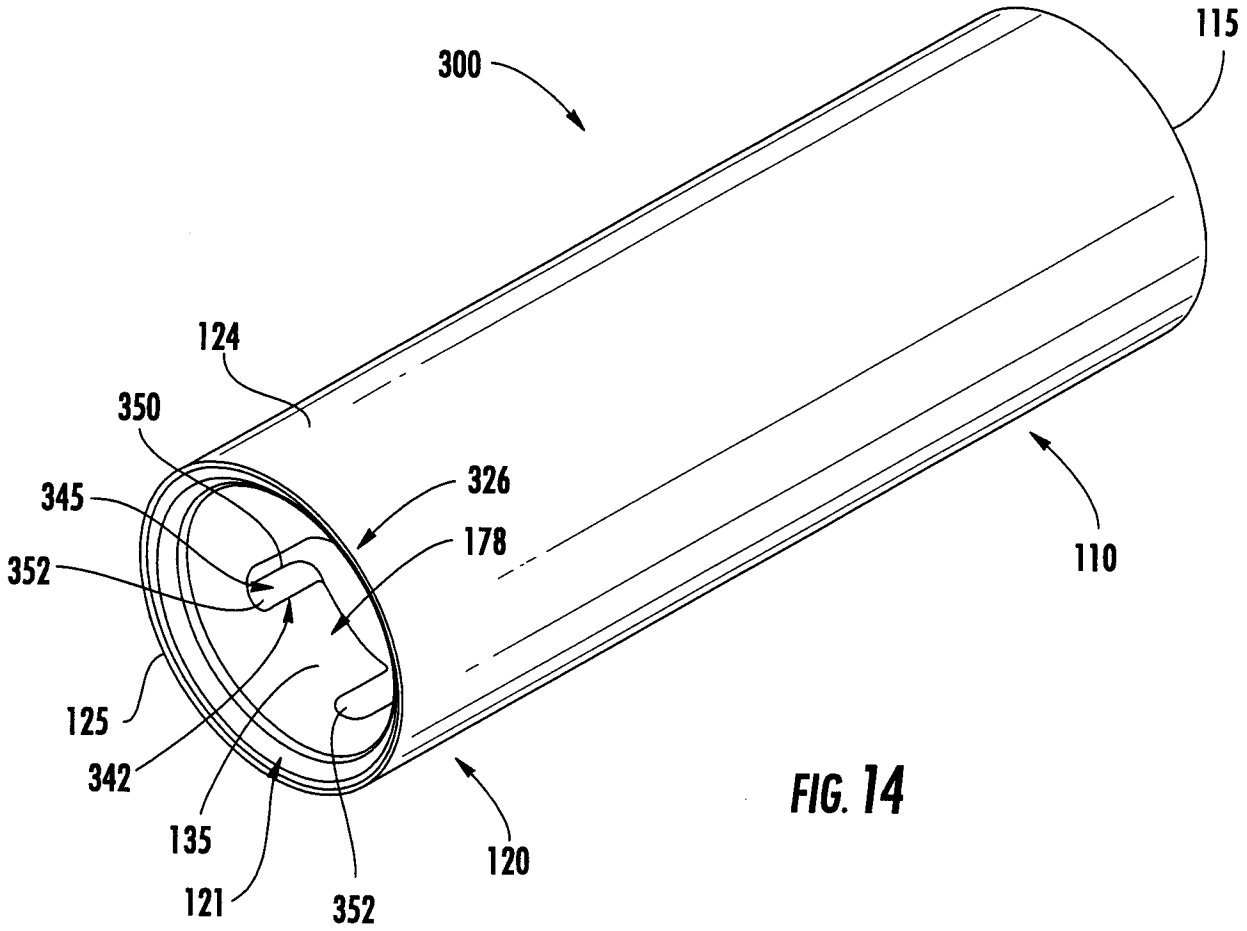
FIG. 14 is an isometric view of a shot cup according to a third exemplary embodiment of the disclosure.
Figure 15A:
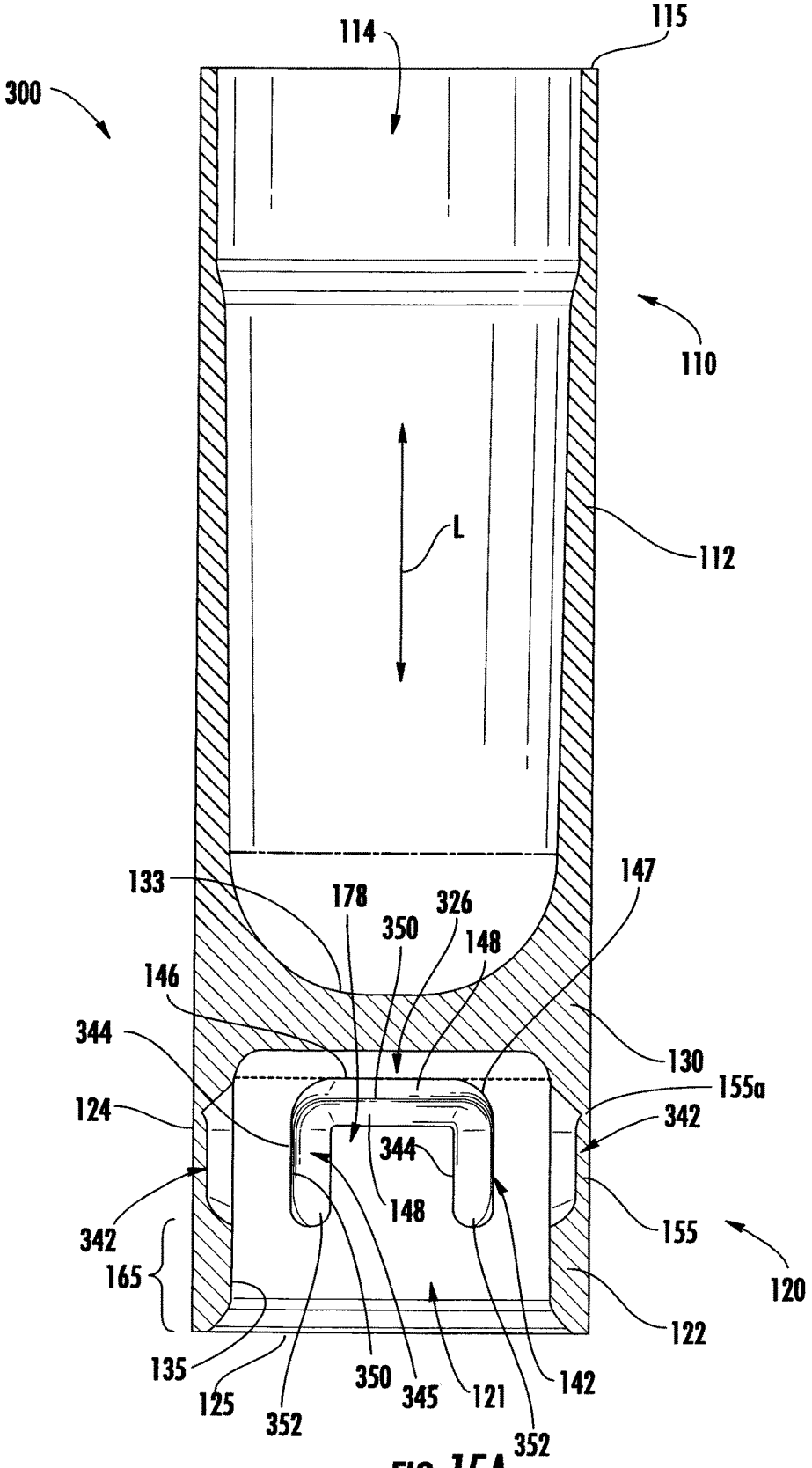
FIG. 15A is a longitudinal cross-sectional view of the shot cup of FIG. 14.
Figure 15B:
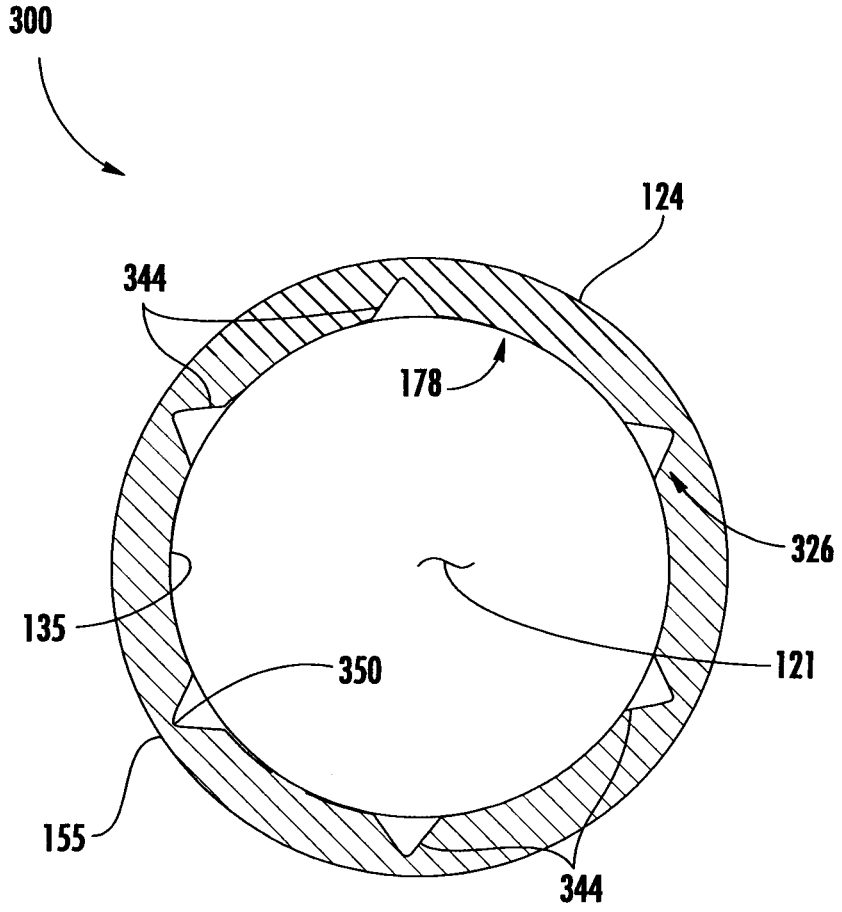
FIG. 15B is a transverse cross-sectional view of a rear cylindrical portion of the shot cup of FIG. 14.
Figure 15C:
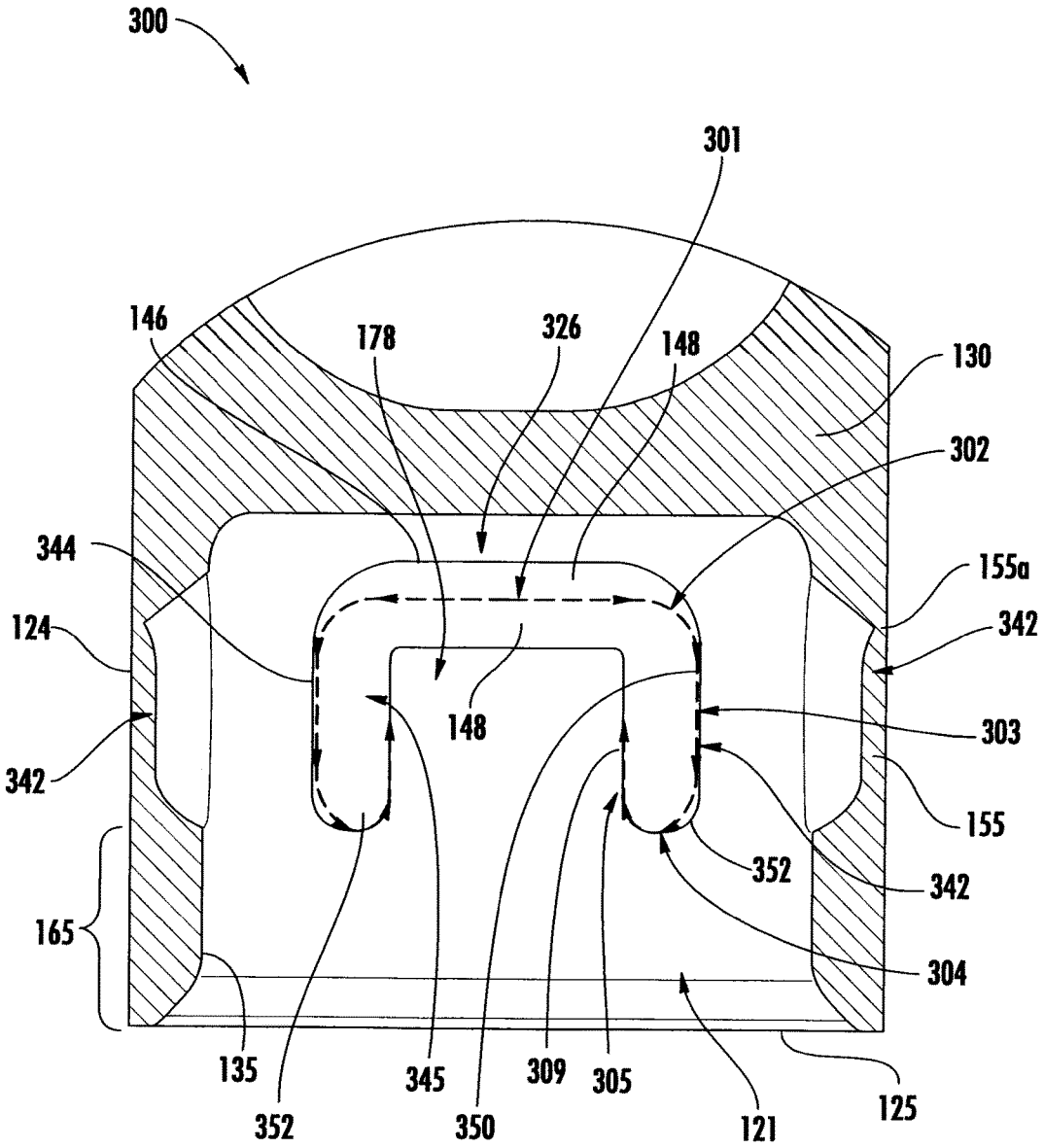
FIG. 15C is a detail view of a rear portion of the cross-sectional view of the shot cup of FIG. 15A.

As shown in FIGS. 14, 15A, and 15C, each of the deceleration features 326 of the shot cup 300 includes a shaped or defined impression 342 disposed in the interior surface 135 of the sidewall 122, and each shaped impression 342 can include a contoured depression 345 formed in the interior surface 135. A round-ended redirector feature 352 can be located at the terminus of each of the legs 344 of the shaped impressions 342. In one exemplary embodiment, the round-ended redirector feature 352 can be configured to redirect web-tearing forces away from the rearward end 125 of the shot cup 300. In an alternative embodiment, the round-ended redirector feature 352 could be configured to redirect these web tearing forces toward desired areas for tearing of the sidewall 122 to a desired or suitable degree. In the illustrated embodiment, the redirection of tearing forces provided by the round-ended redirector feature 352 can help to prevent tear-through in the substantially solid, uninterrupted region 165 of the sidewall 122 in the rear portion 120 of the shot cup 300.

FIG. 15C is a detail view of an interior surface of the wad or shot cup 300 showing the round-ended redirector features 352 and a designed web-tear route for facilitating the web-tearing process, the completion of which ultimately results in the formation of a deceleration petal (e.g., similar to the deceleration pedal 180 shown in FIG. 13). The web-tear route (or potential web-tear route) generally is represented by broken arrows 309. In the illustrated embodiment, the tearing of the web 155*a* can commence in a lateral direction at the forward central portion 301 of the base line 350 of the contoured depression 345, and continue in a clockwise direction along a corner radius 302 where the web 155 can begin to tear along the base line 350. Subsequently, the tearing of the web 155 can continue rearwardly, along a generally straight, longitudinal segment 303. The tearing of the web 155 further can continue along a leg terminus radius 304 (i.e., along the round-ended redirector feature 352), and then forwardly along or towards a second, generally straight, longitudinal segment 305 where the tearing action can stop in one exemplary embodiment. The tearing of the web 155*a*, 155 can proceed along the opposing leg 344 in a similar or identical manner. In one embodiment, the tearing action can occur substantially simultaneously in opposite directions along both sides of the contoured depression 345, for example, starting along the forward central portion 301 of the base line 350 and moving outwardly toward and along the legs 344.

The location of the arrowhead showing the web-tear route 309 in FIG. 15C indicates generally the final or end direction of the tearing forces in one exemplary embodiment. In one embodiment, the round-ended redirector feature 352 can include a tapered portion of the base line 350 configured so that as the base line 350 curves along the round-ended redirector feature 352, the thickness of the sidewall 122 can increase and the depth of the base line 350 can be decreased as needed to an extent sufficient to help control tearing of the web 155 (i.e., to speed up or slow or stop the tearing). In an alternative embodiment, the tearing action could extend only partially along the base line 350 or could extend into the sidewall 122 outside the base line 350. The extent or overall length of the tearing action along the base line 350 of the contoured depression 345 can vary and can depend on the thickness of the sidewall 122, chamber pressure, propellant temperature, and ambient temperature. In one exemplary embodiment, the tearing action generally ceases at some point within the leg terminus radius 304.

The deceleration features 326, including the base lines 350 and/or the round-ended redirector features 352 could be otherwise configured and/or arranged without departing from the disclosure. For example, FIGS. 16A-16D show alternative contoured depressions with alternative round-ended redirector features and web-tearing routes. In the embodiments shown in FIGS. 16A-16D, the web-tearing sequence can be similar or identical to the sequence described with respect to the contoured depressions 345 of FIGS. 14 and 15A-15C.

FIGS. 16A-16D are general detail views showing variations on the contoured depressions 345 (FIG. 15C) with various redirector features 352*a*, 352*b*, 352*c*, 352*d* formed in the end of respective legs 344*a*, 344*b*, 344*c*, 344*d* of the respective contoured depressions 345*a*, 345*b* 345*c*, 345*d*. The legs 344*a*, 344*b*, 344*c*, 344*d* further can have respective alternative shapes with respect to the straight legs 144 shown in FIGS. 2-7 of the first embodiment. Broken arrows 309*a*, 309*b* 309*c*, 309*d* show an example of a final or end direction of the tearing forces and an example of the extent they can be redirected relative to the rearward end 125 of the shot cup according to exemplary embodiments, though other directions of such forces and tearing also can be provided.

Figure 16A:
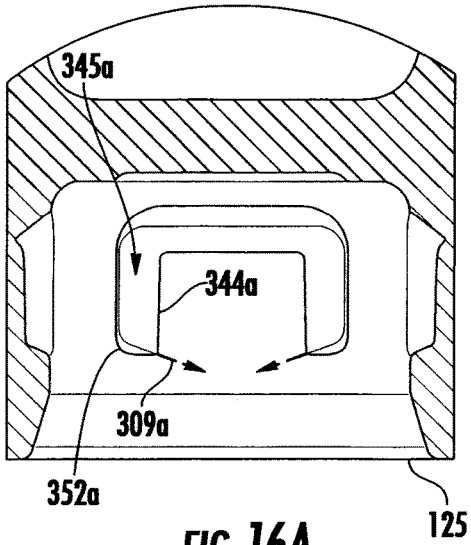
FIGS. 16A, 16B and 16C are cross-sectional detail views of respective rear portions of shot cups according to alternative exemplary embodiments.
Figure 16B:
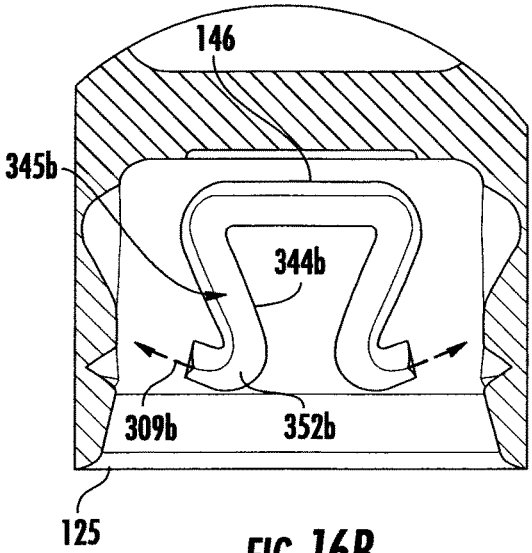
Figure 16C:
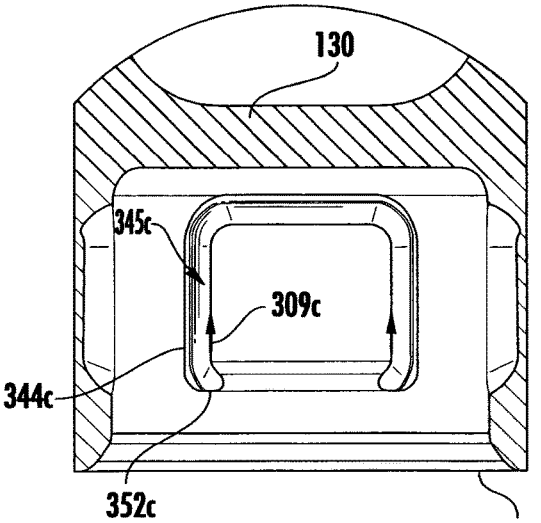
Figure 16D:
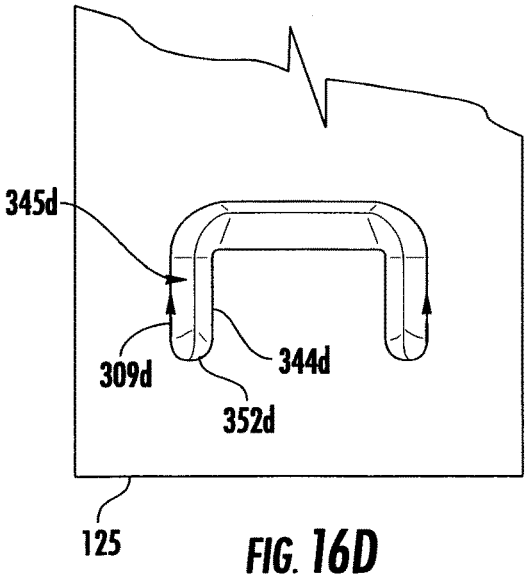
FIG. 16D is a side view showing the external detail of the rear portion of a shot cup according to an alternative exemplary embodiment.

FIGS. 16A-16C illustrate respective examples of embodiments of the contoured depressions formed in the interior surface of the rear portion of the shot cup. FIG. 16D is a partial side view of the exterior surface of a shot cup showing the contoured depression 345*d* formed in the exterior surface. In alternative embodiments, any of the contoured depressions in FIGS. 16A-16D or in the other embodiments could be formed in the exterior or the interior surface of the shot cup without departing from the disclosure.

As shown in FIG. 16A, the contoured depression 345*a* can have an angle-oriented redirector feature 352*a*. In this example, the web-tearing forces are redirected inwardly (e.g., toward the opposing leg 344*a* of the contoured depression 345*a*) and along a partially rearward direction. Accordingly, the redirection angle provided by this redirector feature can help to reduce and/or eliminate tear-through in the rearward end 125 of the shot cup.

As shown in FIG. 16B, the contoured depression 345*b* can include legs 344*b* that are angled inwardly so that of the contoured depression 345*b* is wider along the cross segment 146 than at the ends of the legs. Accordingly, the deceleration petals formed by the contoured depression 345*b* can bend rearward easier and quicker upon exit from the muzzle of the firearm barrel after firing the round. In the embodiment illustrated in FIG. 16B, the legs 344*b* are curved outwardly (e.g., away from the opposing leg of the contoured depression) along the redirector feature 352*b* so that the web-tearing forces are redirected generally outwardly and forwardly, away from the rearward end 125 of the shot cup. The redirection angle provided by this redirector feature further can help reduce and/or eliminate tear-through in the rearward end 125 of the shot cup with respect to the contoured depression 345*a* shown in FIG. 16A.

As shown in FIG. 16C, the round-ended redirector feature 352*c* of the contoured depression 345*c* can curve inwardly (e.g., toward the opposing leg 344*a*) so that the web-tearing forces are redirected about 180 degrees towards the intermediate partition 130 of the shot cup. As shown in FIG. 16D, the contoured depression 345*d* is formed in the exterior surface of the shot cup similarly to the embodiment shown in FIGS. 23A-23C, which is described in more detail below. The redirector features 352*d* can be curved outwardly (e.g., away from the opposing leg 344*a*) so that the web-tearing forces are redirected about 180° towards the intermediate partition 130 similarly to the redirector feature 352*c* of FIG. 16C. The redirection angle provided by the redirector features 352*c* 352*d* can help reduce and/or eliminate tear-through in the rearward end 125 of the shot cup to an additional extent.

It further will be understood that any of the contoured depressions 345, 345*a*, 345*b*, 345*c*, 345*d* and/or the redirector features 352, 352*a*, 352*b*, 352*c*, 352*d* could be otherwise configured and/or arranged without departing from the spirit and/or scope of the present disclosure.

Figure 17:
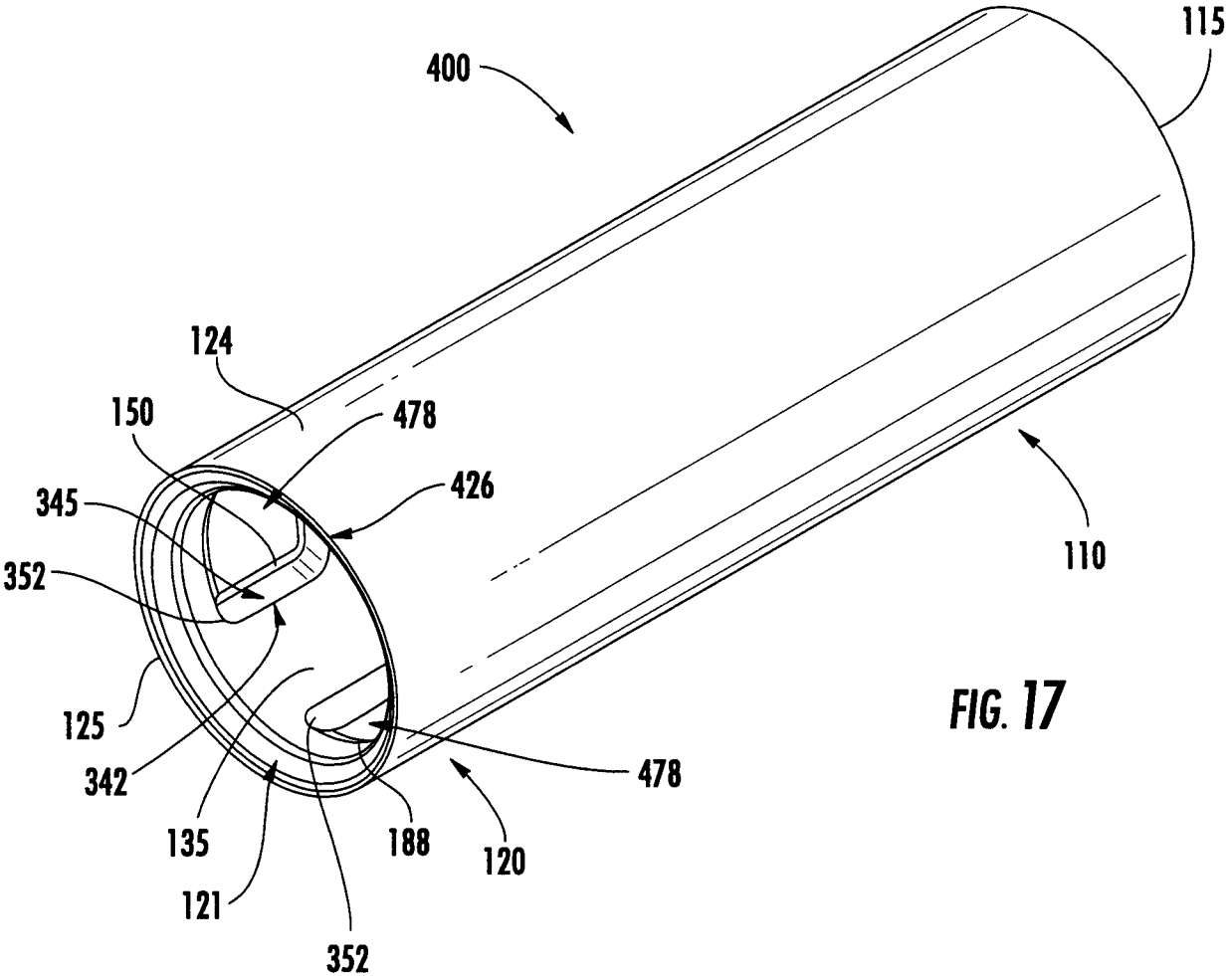
FIG. 17 is an isometric view of a shot cup according to a fourth exemplary embodiment of the disclosure.
Figure 18A:
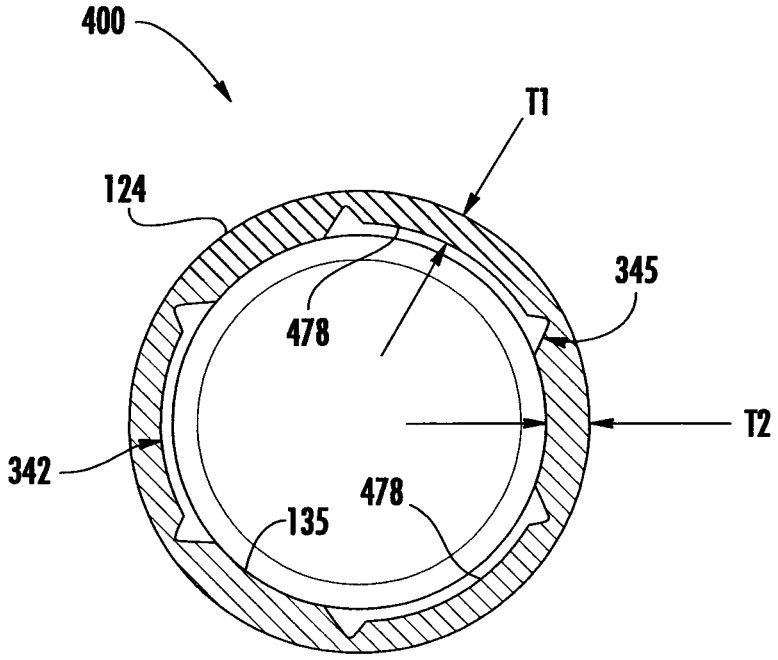
FIG. 18A is a transverse cross-sectional view of a rear cylindrical portion of the shot cup of FIG. 17.
Figure 18B:
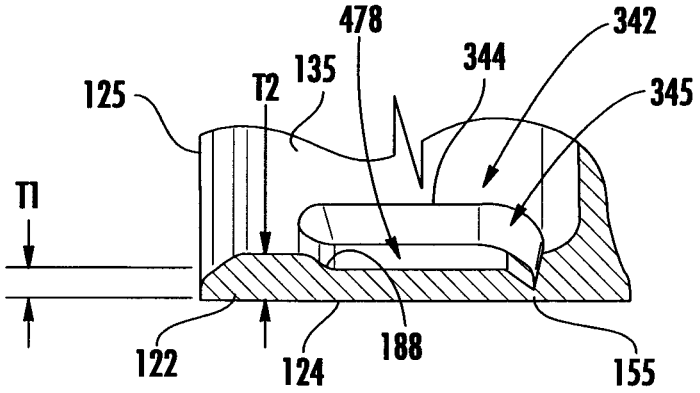
FIG. 18B is a detail cross-sectional view of a rear portion of the shot cup of FIG. 17.

FIGS. 17, 18A, and 18B are views of a wad or shot cup 400 according to a fourth embodiment of the disclosure. This fourth embodiment of the wad or shot cup 400 can have a structure that is generally similar to the third embodiment except for variations noted and variations that will be apparent to one of ordinary skill in the art. Accordingly, similar or identical features of the embodiments have been given like or similar reference numbers. As shown in FIGS. 17-18B, the sidewall 122 is thinner in the latent petal area 478 (e.g., within the shaped impression 342) of the deceleration features 426 than the remainder of the sidewall 122 in the rear portion 120. In contrast, in the third embodiment, the thickness of the latent petal area 178 is substantially the same thickness as the remainder of the sidewall 122 (e.g., outside the shaped impression 342). In one embodiment, the thinner latent petal area 478 allows the deceleration petal formed from the contoured depression 345 to form quicker and bend rearward easier after the shot cup 400 exits the muzzle of the firearm barrel after firing the round of ammunition. This configuration can be desirable, for example, if the chamber pressure is set to a low level such as in the case of a subsonic or other low velocity cartridge and/or if the shot cup 400 material (e.g., High Density Polyethylene or other suitable material) is cold and stiff due to a low ambient temperature.

FIGS. 18B and 18C show a difference between the latent petal area 178 thickness and the sidewall 122 thickness. T1 designates the thinner latent petal area of the shot cup 400 and T2 designates the thicker sidewall 122 area. The T1 dimension can be as much as 50% smaller than the T2 dimension. A radius 188 joins the T1 and T2 sections and can act similar to the living hinge depression 257 shown in FIGS. 11-13 as it allows the formed deceleration petals 190 to rotate easily without creating undue stress in this transition area.

In the illustrated embodiment, the contoured depressions 345 of FIGS. 17-18B can include round-ended redirector features 352 located at the terminus of the legs 344 similar to those shown in FIG. 15C in the third embodiment so that the redirector features 352 can similarly help reduce and/or eliminate tearing of the shot cup 400 through the generally solid, uninterrupted region 165 of the sidewall 122. In one embodiment, the height and width of the latent petal area 478 can be generally square-shaped with a greater surface area than the latent petal area 178 of the third embodiment. The deceleration features 426 including the contoured depressions 345 and/or the latent petal areas 478 could be otherwise configured and/or arranged without departing from the disclosure.

Figure 19:
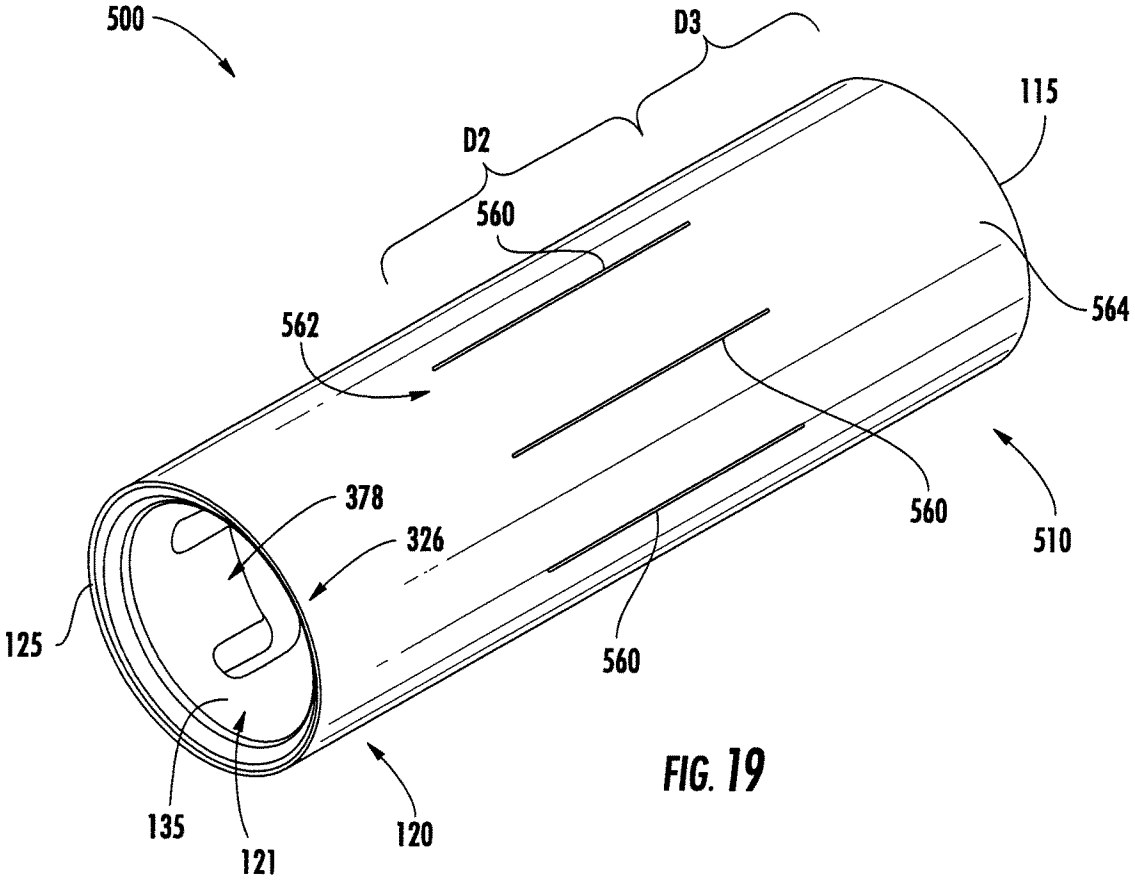
FIG. 19 is an isometric view of a shot cup according to a fifth exemplary embodiment of the disclosure.
Figure 20A:
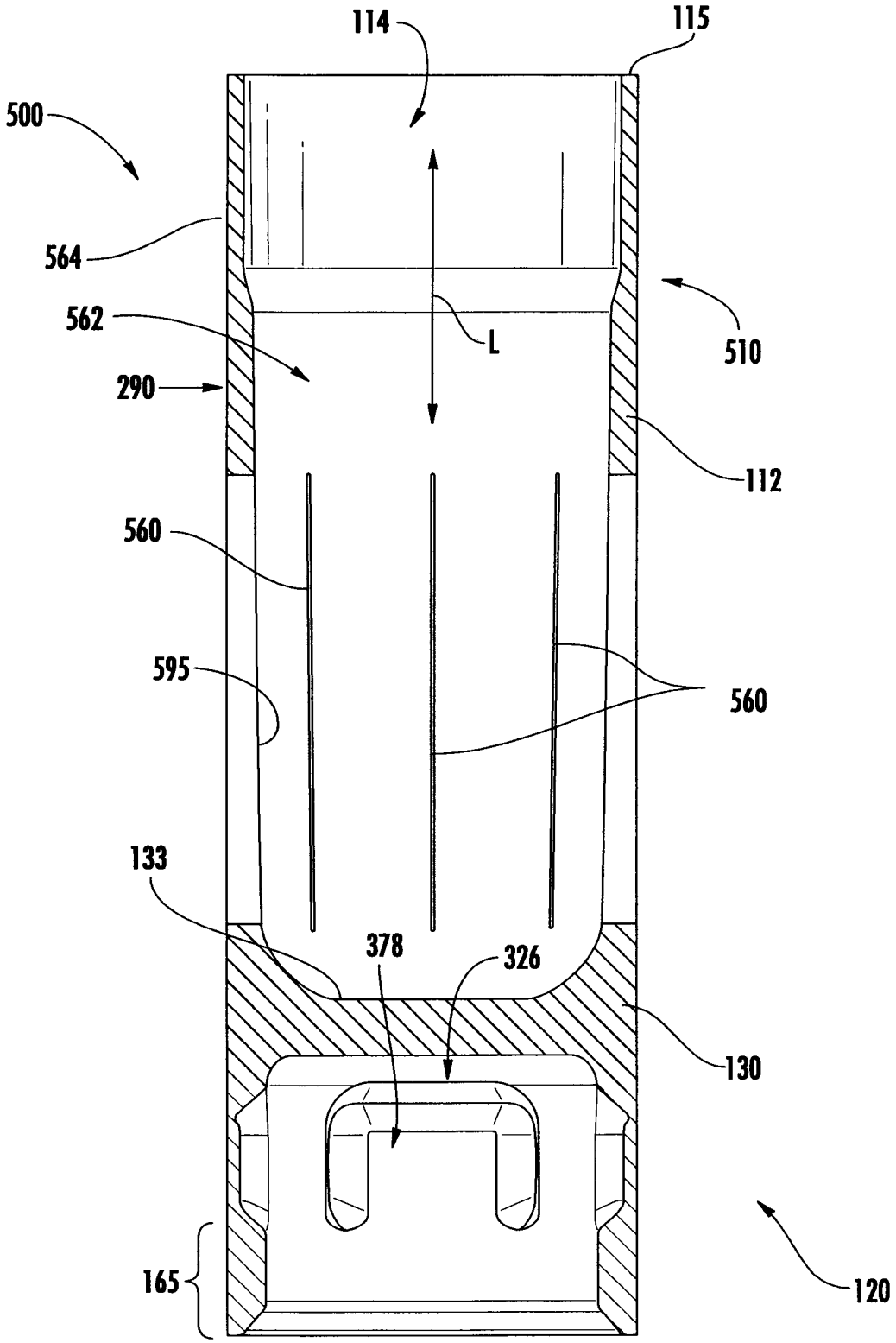
FIG. 20A is a longitudinal cross sectional view of the shot cup of FIG. 19.
Figure 20B:
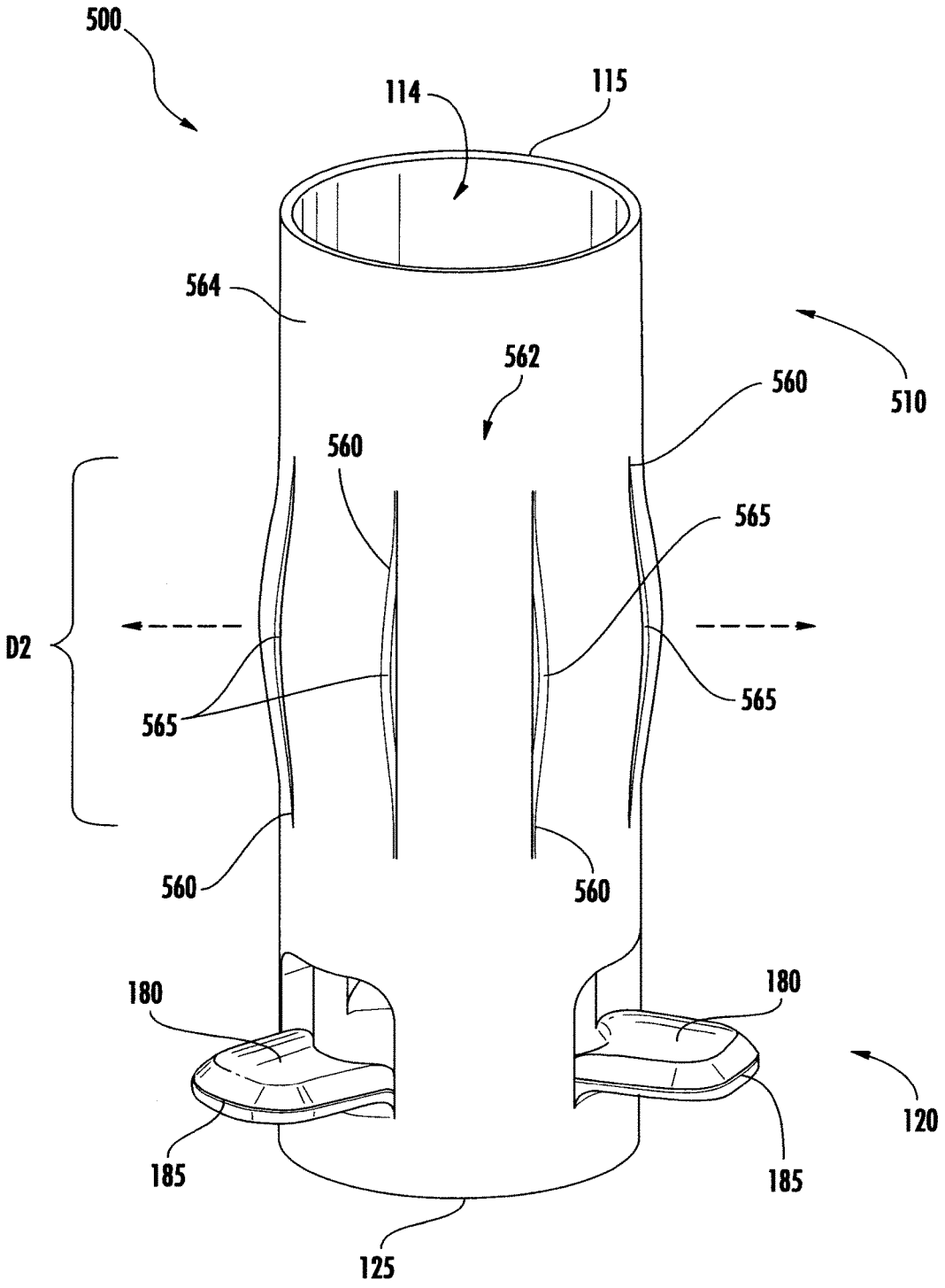
FIG. 20B is an isometric view of the shot cup of FIG. 19 showing widened or expanded slits in the forward cylindrical portion of the shot cup with deceleration petals deployed upon firing, according to the fifth exemplary embodiment of the disclosure.

FIGS. 19, 20A, and 20B show views of a wad or shot cup 500 according to a fifth embodiment of the disclosure. This fifth embodiment can have a structure generally similar to one or more of the embodiments described above, except for variations noted and variations that will be apparent to one of ordinary skill in the art. Accordingly, similar or identical features of the embodiments have been given like or similar reference numbers. As shown in FIG. 19, the shot cup 500 includes several longitudinal slits 560 arranged in a series 562 in the sidewall 112 of the forward cylindrical portion 510 of the shot cup 500. In one embodiment, the purpose of the longitudinal slits 560 is to weaken the sidewall 112 in a slit region D2 in a manner sufficient to allow the sidewall 112 to flex, bulge, and/or expand radially outwardly upon exiting the muzzle of the barrel after firing the round of ammunition in order to dislodge any pellets 16 that may have become embedded in the interior of the sidewall 112. In addition, the longitudinal slits 560 can help dislodge pellets 16 from the intermediate partition 130, including the forwardmost surface 133 (FIG. 20A) of the intermediate partition 130. Any suitable number of longitudinally spaced slits 560 can be included in the series 562 (e.g., two or more slits 560). For example, the series 562 could include three slits 560 arranged around the circumference of the forward cylindrical portion 510. In a more preferable embodiment, four or more slits 560 are included in the series 562. Alternatively, one slit 560 could be included in the slit region 562.

As shown in FIG. 20A, the longitudinal slits 560 and/or the slit region D2 can extend generally proximate to the forward surface 133 of the intermediate partition 130 toward the forward end 115 of the shot cup 500. The longitudinal slits 560 and the slit region D2 can be spaced from the forward end 115 by a distance D3 to define an un-slit portion 564 at the front of the shot cup 500 (FIGS. 19-20B). The longitudinal slits 560 can extend any suitable length in the forward portion 510 without departing from the disclosure. For example, in one alternative embodiment, the longitudinal slits 560 could extend forwardly from the forwardmost surface 133 of the intermediate partition 130 to the forward end 115 of the shot cup 500 so that the distance D3 is within about 0.100-0.200 inch of the forward end 115, though this distance can be varied. In one embodiment, the longitudinal slits 260 also can vary in width from about 0.0005 inch to about 0.003 inch or more. Alternatively, the slits could have any suitable width without departing from the disclosure. The forward cylindrical portion 510 including the longitudinal slits 560 could be otherwise configured and/or arranged without departing from the disclosure.

In addition, hard pellets (e.g., steel or tungsten alloy pellets) can easily become embedded in the relatively soft plastic of any wad or shot cup, including the shot cup 500. Embedded pellets can affect the size, shape, and/or density of the downrange pattern if they are allowed to remain in the shot cup 500. In one embodiment, the higher the muzzle velocity of the cartridge and/or the higher the ambient temperature, the greater the chance of pellets 16 becoming embedded within the interior wall 112 of the wad or shot cup 500. In the illustrated embodiment, upon firing the round of ammunition 10, the shot cup 500 undergoes various stresses as a result of the inertia associated with acceleration, and the pellets 16 can be driven both rearwardly and radially outwardly as the shot cup 500 is accelerated by the propellant gas, such that one or more pellets 16 can become at least partially embedded within the interior sidewall 112.

When the wad or shot cup 500 with its payload escapes the confines of the barrel as it exits the muzzle after firing the round of ammunition, the acceleration of the shot cup 500 can tend to cause the slit region D2 of the shot cup 500 to squat or shorten along the longitudinal axis L, and widen radially (FIG. 20B). This in turn causes openings 565 to form and widen between the longitudinal slits 560 as shown in FIG. 20B. The outward facing broken arrows in FIG. 20B indicate the generally radial direction in which the radial expansion or bulging occurs as the individual pellets 16 are urged outwardly due to the acceleration of the shot cup after firing the round of ammunition. As a result, in the illustrated embodiment, this flexing/squatting action can facilitate or urge embedded pellets to break free from the interior sidewall. It has been found during firing tests of wads or shot cups formed according to the principles of the present invention, that when longitudinal slits 560 are formed in the shot cup 500, embedded pellets 16 can be effectively dislodged from the interior sidewall 112 as a result of the flexion and outward bulging of the weakened sidewall 112 in the slit region D2.

As shown in FIGS. 19 and 20A, the shot cup 500 includes deceleration features 326 with latent petal areas 378 similarly to those described above with respect to the third embodiment (e.g., FIGS. 14-15C) formed in the interior surface 135 of the rearward portion 120 of the shot cup 500. The deceleration features 326 can form petals 180 as shown in FIG. 20B. Alternatively, any suitable deceleration features could be incorporated into the shot cup 500, or deceleration features could be omitted from the shot cup 500 without departing from the disclosure.

Figure 21A:
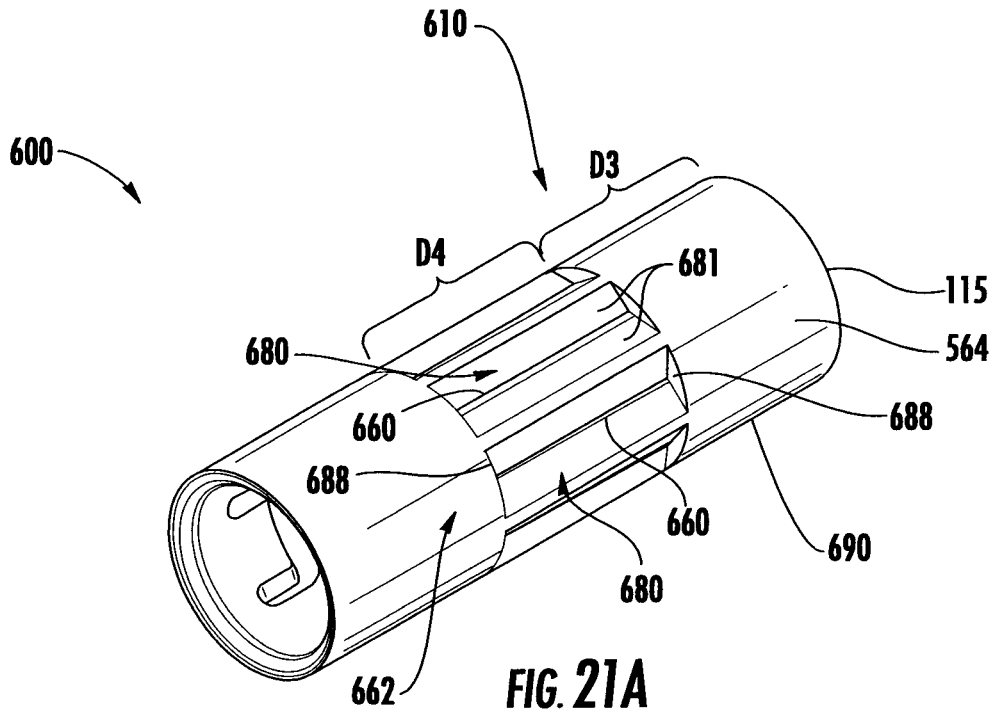
FIG. 21A is an isometric view of a shot cup according to a sixth exemplary embodiment of the disclosure.
Figure 21B:
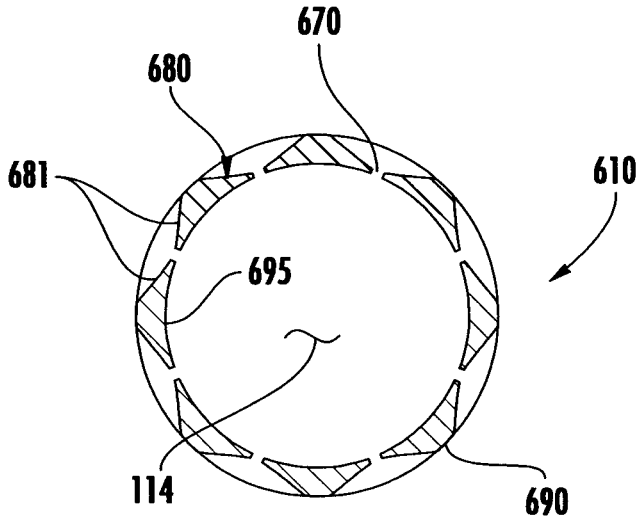
FIG. 21B is a transverse cross sectional view of a forward cylindrical portion of the shot cup of FIG. 21A.
Figure 21C:
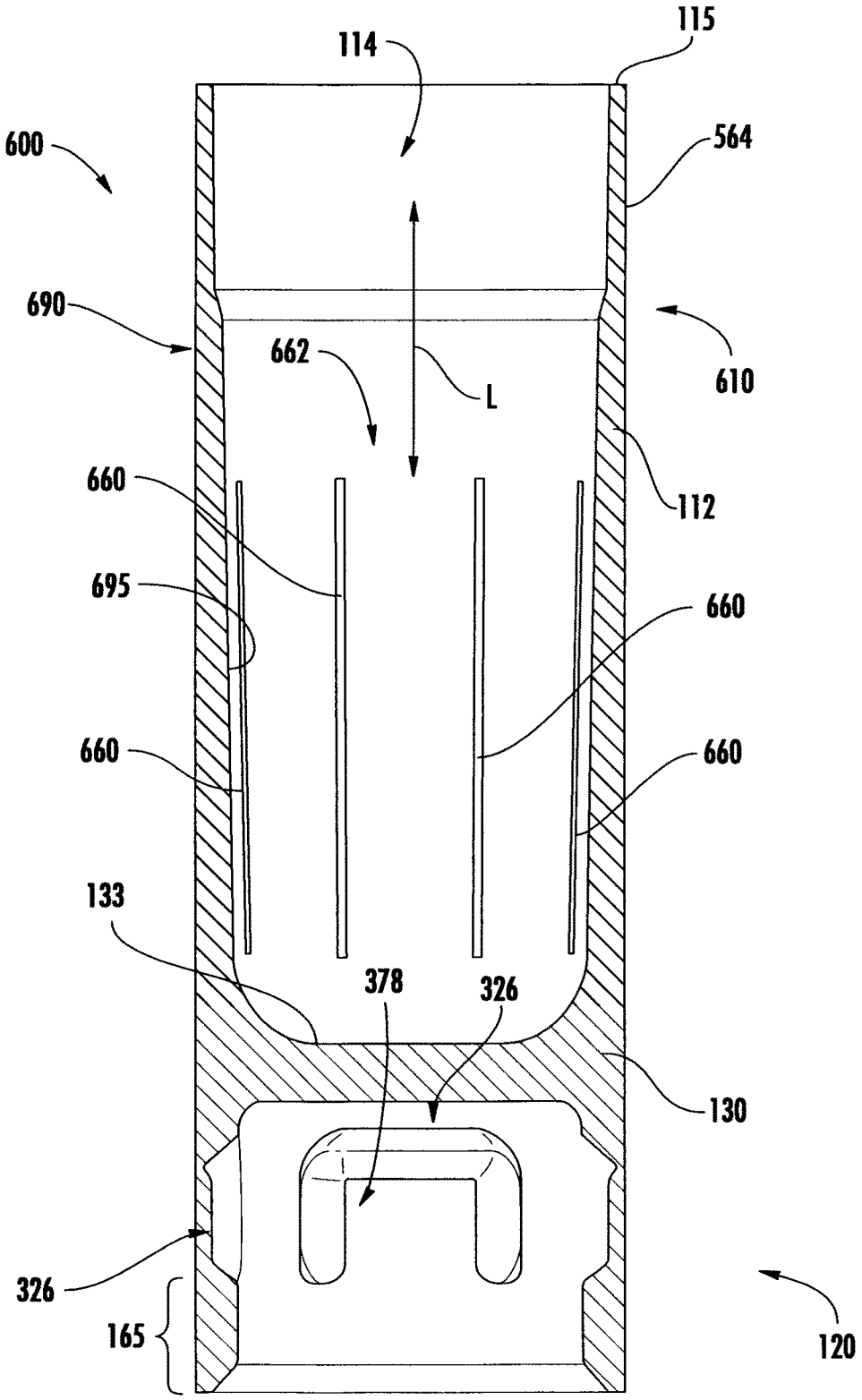
FIG. 21C is a longitudinal cross-sectional view of the shot cup of FIG. 21A.

FIGS. 21A-21C illustrate a wad or shot cup 600 according to a sixth embodiment of the disclosure. Shot cup 600 can have a structure that is generally similar to one or more of the embodiments discussed above, except for variations noted and variations that will be apparent to one of ordinary skill in the art. Accordingly, similar or identical features of the embodiments have been given like or similar reference numbers in most of the drawing figures. As shown in FIG. 20A, the shot cup 600 includes several V-shaped, longitudinal indentions (essentially, angular valleys) 680 formed in the outer surface 690 of the forward cylindrical portion 610. Each of the longitudinal indentations 680 can include a respective longitudinal slot 660. The longitudinal indentations 680 and the associated longitudinal slots 660 can be arranged in a series 662 in a slit region D4 and can be spaced apart from the forward end 115 of the shot cup 600 by the distance D3. Accordingly, the un-slit portion 564 can extend between the forward end 115 and the slit region D4. In one embodiment, each longitudinal slot 660 can run along substantially the entire length of each longitudinal indention 680 (e.g., generally at its lowest point or vertex). The longitudinal slots 660 and the longitudinal indentations 680 can extend any suitable length in the forward portion 610 without departing from the disclosure. Additionally, the series 662 can include any suitable number of longitudinal slots 660 and longitudinal indentations 680 arranged around the circumference of the forward cylinder portion 610.

As shown in FIGS. 21A and 21C, the longitudinal indentions 680 can terminate in fore and aft ends 688 within the sidewall 112 of the forward cylindrical portion 610 of the shot cup 600. In the illustrated embodiment, the ends 588 of the longitudinal indentions 680 lie perpendicular to the longitudinal axis of the shot cup 600. Alternatively, the ends 688 could extend at any suitable angle. As shown in FIGS. 21A and 21B, the longitudinal indentations 680 can include oblique walls 681 extending between the outer surface 690 of the shot cup 600 and the respective longitudinal slot 660. In one embodiment, the width of each of the longitudinal indentions 680 at the outer surface 690 of the shot cup 600 can be from about 0.060 inch to about 0.140 inch or more. In the illustrated embodiment, as shown in FIGS. 21B and 21C, the interior surface 695 of the sidewall 112 can be generally un-indented, revealing only the length and width of the longitudinal slots 660 in the interior 114 of the forward cylindrical portion 610. The longitudinal indentations 680 and/or the longitudinal slots 660 could be otherwise configured and/or arranged without departing from the disclosure. For example, the walls 681 of the longitudinal indentations 680 could be curved.

Similar to the embodiment of the wad or s hot cup 500 shown in FIG. 20B, the longitudinal slots 660 (FIGS. 21B-21C) can allow the slit region D4 to flex to help dislodge pellets 16 from the interior surface of the shot cup 600. In addition, the longitudinal indentations 680 can allow a greater flexion and outward radial bulging response along the slit region D4 when the shot cup 600 exits the muzzle of the firearm barrel (e.g., the sidewall 112 is generally weaker and more readily collapsible). In one embodiment, the weakness of the sidewall 112 can be due to a reduction in the volume of material comprising the sidewall 112 in the areas of the longitudinal indentions 680 (e.g., as shown in FIG. 21B). The greater degree of flexion and bulging of the weakened sidewall 112 can result in a greater ability to dislodge any pellets 16 that may have become embedded in the interior of the sidewall 112 or any portion of the intermediate partition 130, including the forwardmost surface 133 of the intermediate partition 130 (FIG. 21C).

Figure 22A:
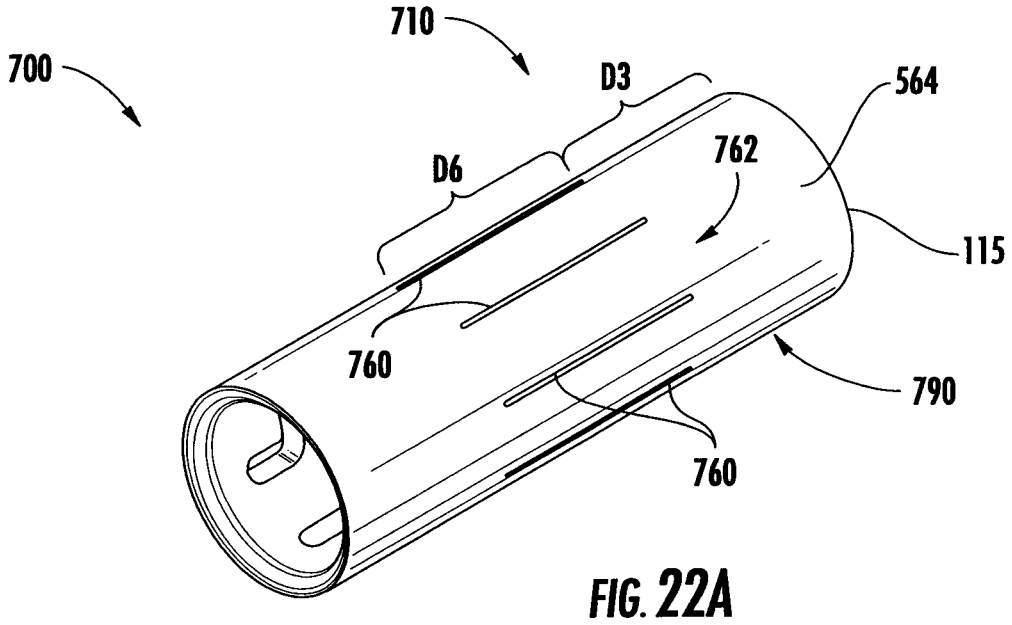
FIG. 22A is an isometric view of a shot cup according to a seventh exemplary embodiment of the disclosure.
Figure 22B:
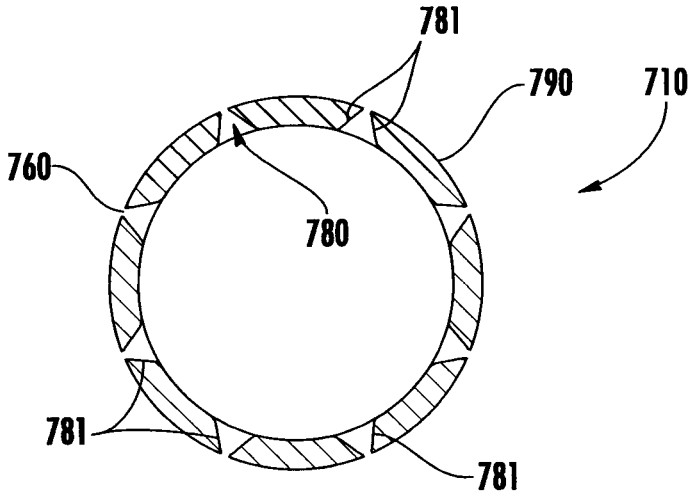
FIG. 22B is a transverse cross sectional view of a forward cylindrical portion of the shot cup of FIG. 22A.
Figure 22C:
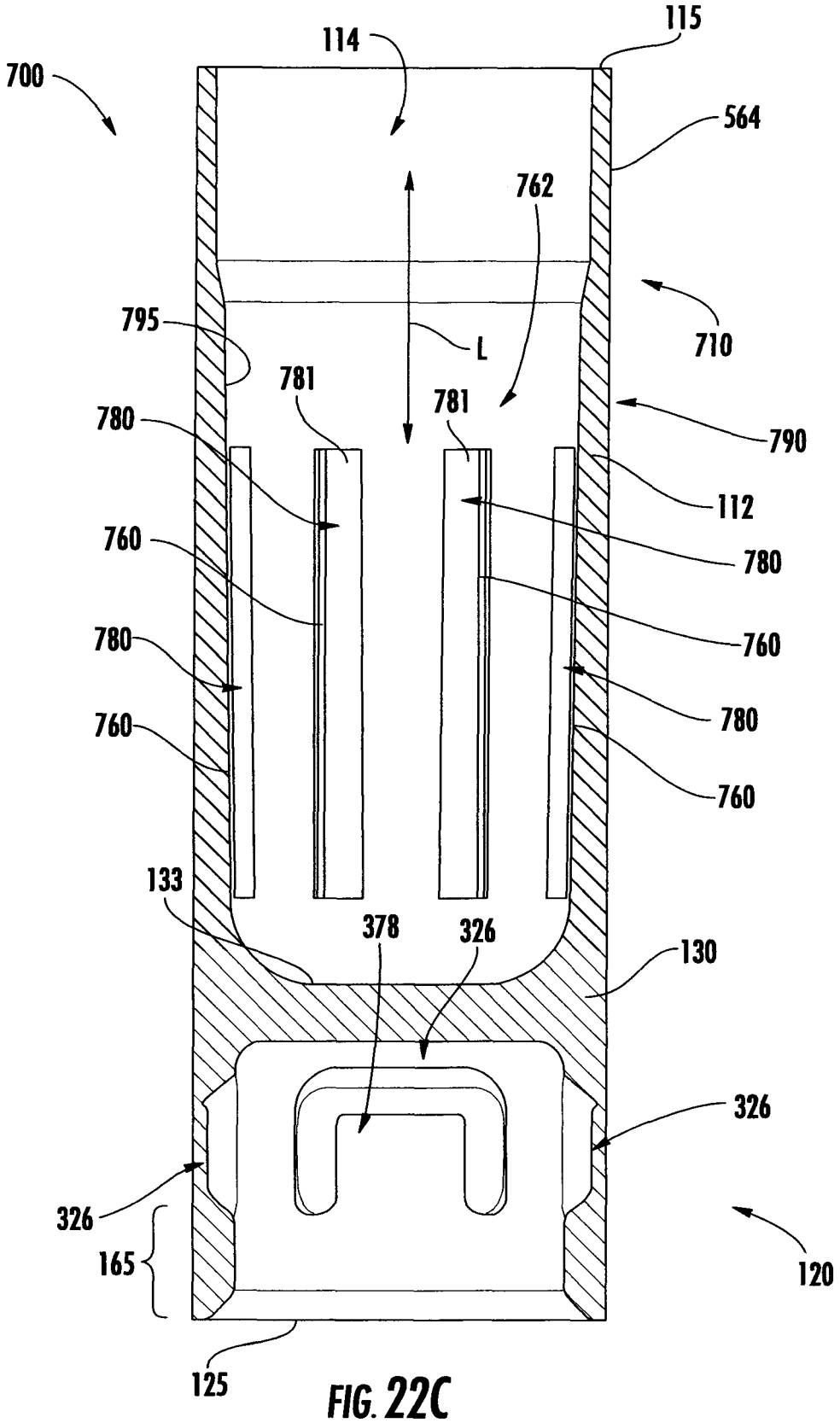
FIG. 22C is a longitudinal cross-sectional view of the shot cup of FIG. 22A.

FIGS. 22A-22C show a wad or shot cup 700 according to a seventh embodiment of the disclosure, which wad or shot cup 700 can have a structure that is generally similar to one or more of the above-described embodiments, except for variations noted and variations that will be apparent to one of ordinary skill in the art. Accordingly, similar or identical features of the embodiments have been given like or similar reference numbers in most of the drawing figures. As shown in FIGS. 22B and 22C, the V-shaped, longitudinal indentions 780 are formed in the interior surface 795 of the forward cylindrical portion 710 instead of the exterior surface 790 as in the sixth embodiment. Accordingly, each of the longitudinal indentations 780 can include two oblique walls extending from the interior surface 795 to a respective longitudinal slot 760 at the exterior surface 795. Each longitudinal slot 760 can run along substantially the entire length of each longitudinal indention 780 generally at its vertex. As shown in FIG. 22A, the exterior surface 790 of the sidewall 112 can be generally un-indented, revealing only the length and width of the longitudinal slots 760 from the exterior of the shot cup 700. Further, as shown in FIG. 22A, the longitudinal slots 760 and the respective longitudinal indentations 780 can be arranged in a series 762 around the circumference of the forward cylinder portion 710 in a slit region D6 that is spaced apart from the forward end 115 of the shot cup 700 by the distance D3.

In the illustrated embodiment, the longitudinal slots 760 and the respective longitudinal indentations 780 can allow the slit region D4 to flex to help dislodge pellets 16 from the interior surface of the shot cup 600 similarly to external longitudinal indentations 680 of the sixth embodiment. The longitudinal indentations 780 and/or the longitudinal slots 760 could be otherwise configured and/or arranged without departing from the disclosure. For example, the oblique walls 781 of the longitudinal indentations 780 could be curved. Additionally, the longitudinal slots 760 and the longitudinal indentations 780 could extend any suitable length in the forward portion 710 of the shot cup 700. Further, the series 762 can include any suitable number of longitudinal slots 760 and longitudinal indentations 780 arranged around the circumference of the forward cylinder portion 710.

Figure 23A:
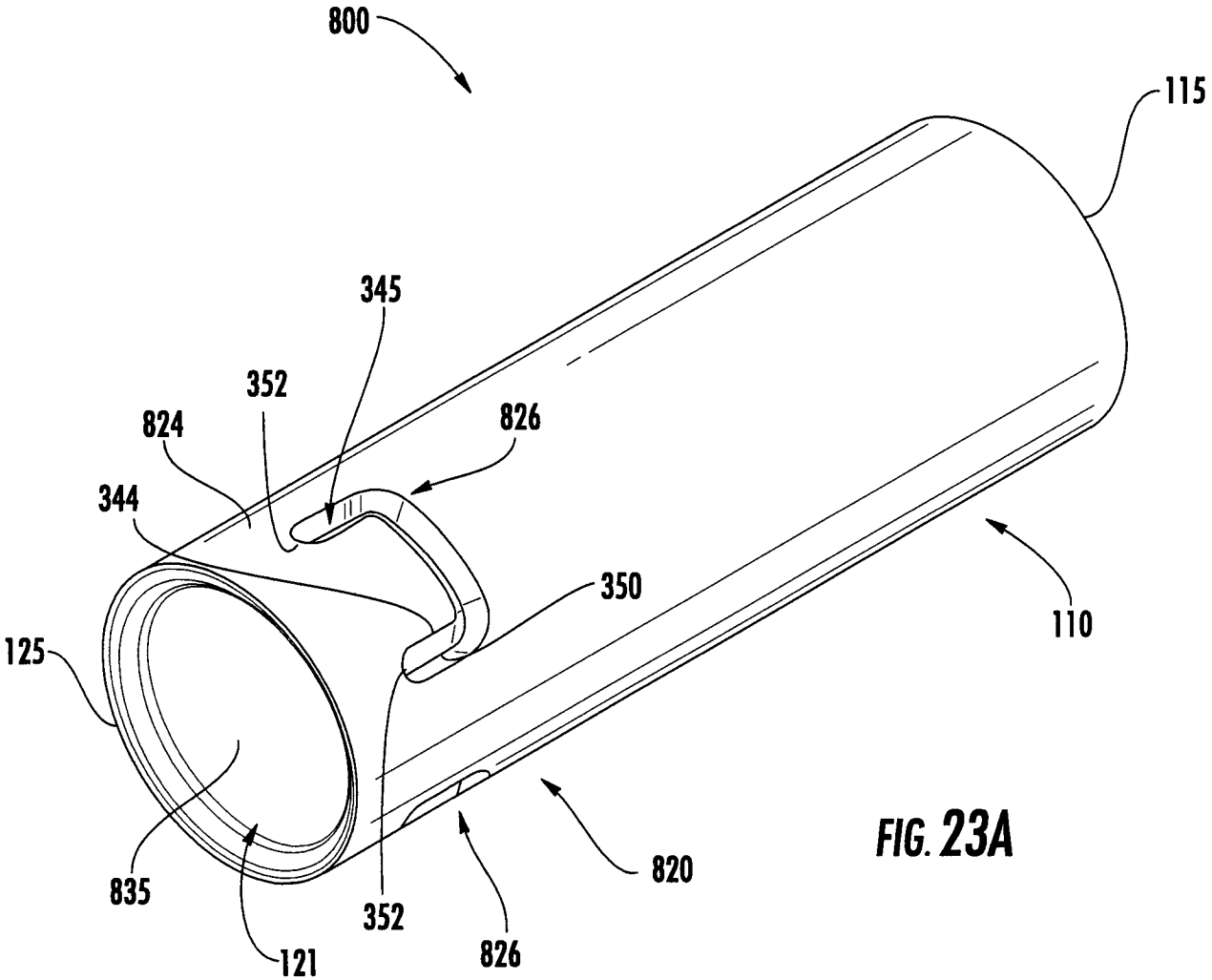
FIG. 23A is an isometric view of a shot cup according to an eighth exemplary embodiment of the disclosure.
Figure 23B:
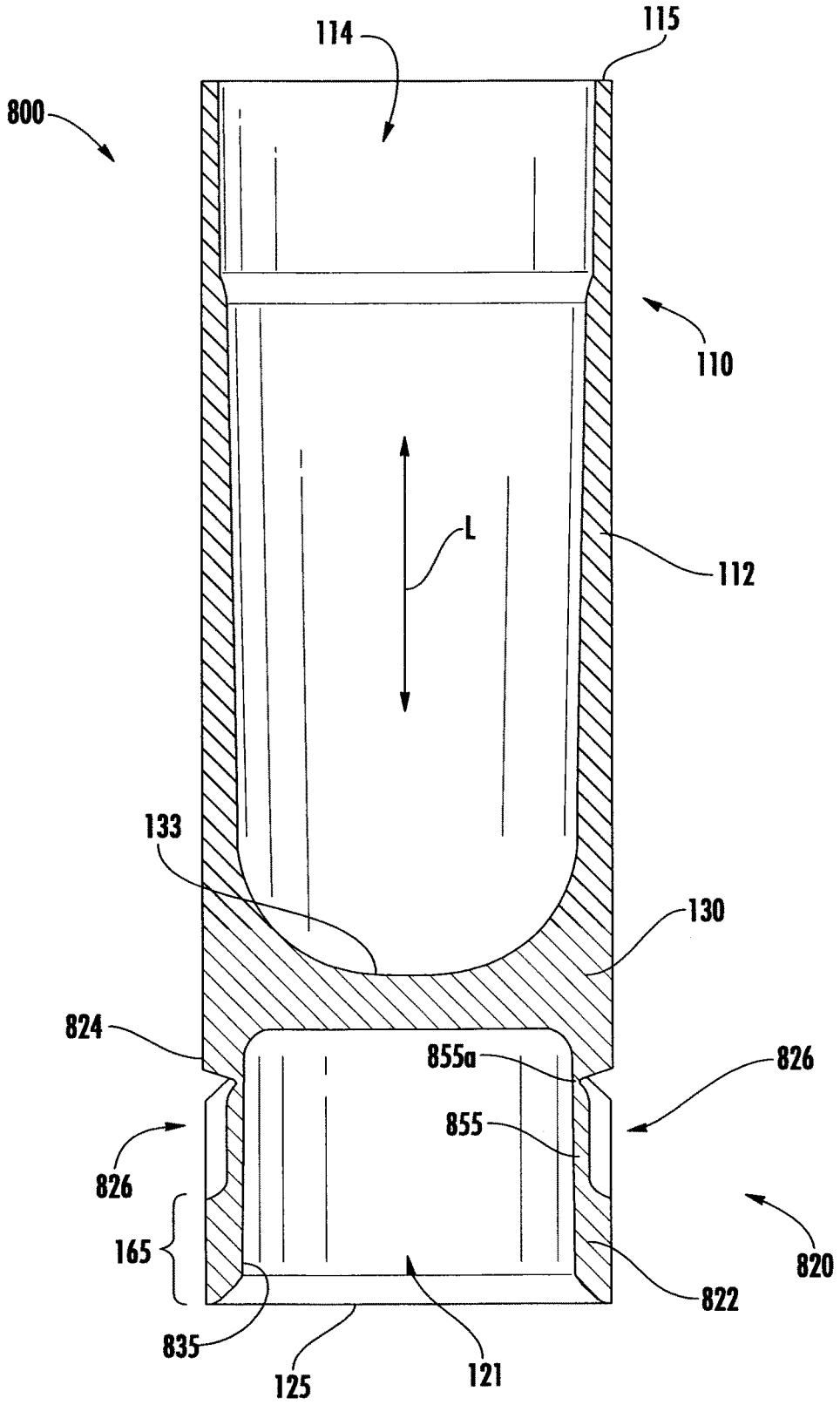
FIG. 23B is a longitudinal cross-sectional view of the shot cup of FIG. 23A.
Figure 23C:
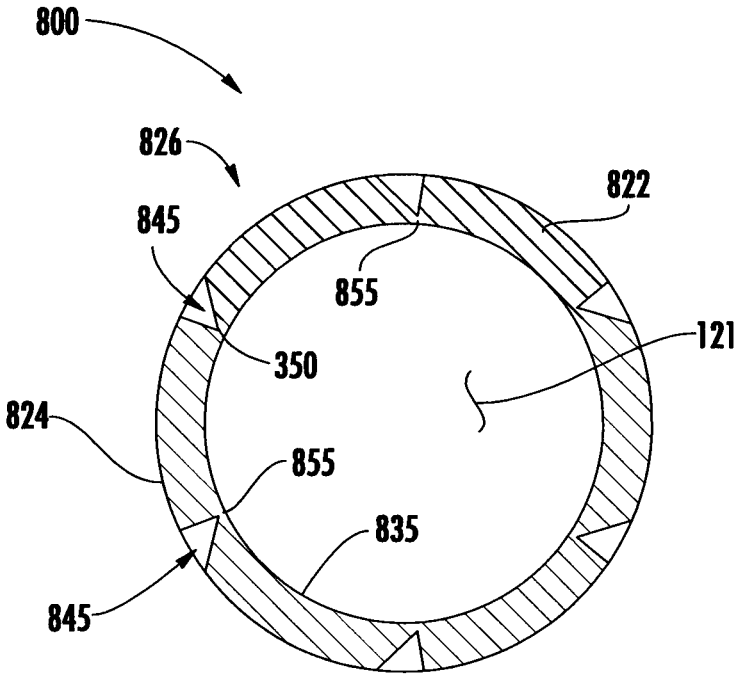
FIG. 23C is a transverse cross sectional view of a rear cylindrical portion of the shot cup of FIG. 23A.

FIGS. 23A-23C are views of a wad or shot cup 800 according to an eighth embodiment of the disclosure. The wad or shot cup 800 can have a structure that is generally similar to one or more of the embodiments described above, except for variations noted and variations that will be apparent to one of ordinary skill in the art. Accordingly, similar or identical features of the embodiments have been given like or similar reference numbers. As shown in FIG. 23A, the latent deceleration features 826 are formed in the exterior surface 824 of the sidewall 822 of the rear cylinder portion 820. In the illustrated embodiment, the latent deceleration features 826 can be similar to the deceleration features 326 (FIG. 15A) of the third embodiment and can similarly form deceleration petals (not shown). The deceleration features 826 (FIGS. 23A-23C) can include similar shaped impressions 342 (FIG. 15A) as those shown and described above. Accordingly, each shaped impression 342 can include a contoured depression 345, a base line 350, and round-ended redirector features 352. As shown in FIGS. 23B and 23C, webs 855, 855*a* can extend along the base line 350 between the contoured depression 345 and the interior surface 835. The webs 855, 855*a* can be similar to the webs 155, 155*a* (FIG. 15A) of the third embodiment except that the webs 155, 155*a* (FIGS. 23A-23C) are adjacent the exterior surface while the webs 855, 855*a* are adjacent the interior surface. The deceleration features 826 in the shot cup 800 can work in a similar manner as described in the third embodiment where high pressure gas in the interior 121 of the rear cylinder portion 820 can apply pressure against the interior surface 835, tearing through the webs 155, 155*a* along the base lines 350 to form the deceleration petals (not shown). The shot cup 800 including the deceleration features 826 could be otherwise configured and/or arranged without departing from the disclosure. Various combinations of features disclosed herein can be incorporated into the shot cup 800 and the other embodiments disclosed herein without departing from the disclosure.

While the deceleration features and longitudinal slits are described in relation to a shotshell in the above embodiments, the deceleration features and/or the longitudinal slits could be incorporated into other types of ammunition. For example, other types of ammunition such as a sabot or pusher wad for muzzle loading applications could incorporate the deceleration features and/or the longitudinal slits according to the present invention therein.

It further will be understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

Still further, the corresponding structures, materials, acts, and equivalents of all means plus function elements in any claims below are intended to include any structure, material, or acts for performing the function in combination with other claim elements as specifically claimed.

Those skilled in the art will appreciate that many modifications to the exemplary embodiments are possible without departing from the scope of the invention. In addition, it is possible to use some of the features of the embodiments described without the corresponding use of the other features. Accordingly, the foregoing description of the exemplary embodiments is provided for the purpose of illustrating the principle of the invention, and not in limitation thereof, since the scope of the invention is defined solely be the appended claims.

We claim:

1. A shot cup for being fired from a firearm, the shot cup comprising:

a body having a sidewall, a forward portion at least partially defining an open-ended interior chamber for receiving at least a portion of a payload therein, a rearward portion at least partially defining an interior chamber for receiving at least a portion of a propellant charge therein and extending to a rearward end of the body, and an intermediate portion between the forward portion and the rearward portion; and a latent deceleration feature located along the rearward portion of the body between the intermediate portion and the rearward end of the body, the latent deceleration feature configured to be deployed from the sidewall to an extent sufficient to impart a substantial deceleration of the shot cup configured to facilitate a separation of the payload from the shot cup after the shot cup is fired from the firearm, the latent deceleration feature comprising at least one impression formed in a surface of the sidewall spaced forwardly from the rearward end of the body.

2. The shot cup of claim 1, wherein the at least one impression extends only partially into a thickness of the sidewall.

3. The shot cup of claim 1, wherein the surface of the sidewall is a first surface, the sidewall comprises an opposing second surface, and the second surface is generally uninterrupted opposite to the latent deceleration feature.

4. The shot cup of claim 1, wherein the impression comprises a cross segment, and a first leg and a second leg extending in a direction normal from the cross segment.

5. The shot cup of claim 4, wherein at least a portion of each of the first leg and the second leg extends generally parallel to a longitudinal axis of the shot cup.

6. The shot cup of claim 1, wherein the at least one impression comprises a cross segment, first and second legs extending from the cross segment, and a base line extending along the cross segment, the first leg, and the second leg, the base line being recessed with respect to the surface, and wherein the sidewall is configured for tearing along the base line in the at least one impression as the latent deceleration feature is deployed.

7. The shot cup of claim 6, wherein each of the first leg and the second leg comprises a respective redirector feature opposite to the cross segment, and wherein the redirector feature is configured for redirecting the tearing of the sidewall at least partially away from a direction extending toward the rearward end of the body.

8. The shot cup of claim 7, wherein the redirector feature comprises a curved portion of the base line at each end of the respective first leg and second leg.

9. The shot cup of claim 1, wherein the surface of the sidewall is a first surface, and wherein the sidewall comprises a second surface opposite the first surface thereof, and whereof the impression comprises a base line extending therealong, the base line being recessed with respect to the first surface, and is spaced apart from the second surface of the sidewall to at least partially define a web configured for tearing along the base line as the latent deceleration feature is deployed.

10. The shot cup of claim 9, wherein the at least one impression comprises two oblique walls, each extending between the first surface and the base line.

11. The shot cup of claim 9, wherein the at least one impression comprises a redirector feature at an end thereof, and wherein the redirector feature is configured for redirecting the tearing of the web at least partially away from a direction extending toward the rearward end of the sidewall.

12. The shot cup of claim 1, wherein the shot cup further comprises a series of longitudinal slits extending along a slit region of the forward portion so that the forward portion expands radially in the slit region after the shot cup is fired from the firearm for at least partially dislodging at least a portion of the payload from the forward portion.

13. A round of ammunition comprising:

a body;

a propellant charge at least partially contained in the body;

a wad at least partially received in the body, the wad comprising a forward portion defining a chamber for receiving at least a portion of a payload therein, and a rearward portion at least partially defining an interior chamber for receiving at least a portion of the propellant charge therein and having a sidewall extending to a rearward end of the wad; and at least one latent deceleration feature located along the rearward portion of the wad and configured for deploying in response to gas pressure upon firing of the round of ammunition to substantially decelerate the wad after firing of the round of ammunition adapted to facilitate separation of the wad from the payload, the at least one latent deceleration feature comprising an impression formed in a surface of the sidewall of the rearward portion adjacent the interior chamber of the rearward portion, the impression being spaced forwardly from the rearward end of the wad.

14. The round of ammunition of claim 13, wherein the at least one impression extends only partially into a thickness of the sidewall of the wad.

15. The round of ammunition of claim 13, wherein the surface of the sidewall of the rearward portion is a first surface, the sidewall of the rearward portion comprises an opposing second surface, and the second surface is generally uninterrupted opposite to the at least one latent deceleration feature.

16. The round of ammunition of claim 13, wherein the impression of the at least one latent deceleration feature comprises a cross segment and a first leg and a second leg extending in a direction normal from the cross segment.

17. The round of ammunition of claim 16, wherein at least a portion of each of the first leg and the second leg extends generally parallel to a longitudinal axis of the wad.

18. The round of ammunition of claim 13, wherein the impression of the at least one latent deceleration feature comprises a cross segment, first and second legs extending from the cross segment, and a base line extending along the cross segment, the first leg, and the second leg, the base line being recessed with respect to the surface, and wherein the sidewall of the rearward portion is configured for tearing along the base line in the impression as the at least one latent deceleration feature is deployed.

19. The round of ammunition of claim 18, wherein each of the first leg and the second leg comprises a respective redirector feature opposite to the cross segment, and wherein the redirector feature is configured for redirecting the tearing of the sidewall of the rearward portion at least partially away from a direction extending toward the rearward end of the wad.

20. The round of ammunition of claim 19, wherein the redirector feature comprises a curved portion of the base line at each end of the respective first leg and second leg.

21. The round of ammunition of claim 13, wherein the sidewall of the rearward portion comprises a second surface opposite the first surface thereof, and wherein the impression of the at least one latent deceleration feature comprises a base line extending therealong, the base line being recessed with respect to the first surface and spaced apart from the second surface of the sidewall of the rearward portion to at least partially define a web configured for tearing along the base line as the at least one latent deceleration feature is deployed.

22. The shot cup of claim 21, wherein the impression of the at least one latent deceleration feature comprises two oblique walls, each extending between the first surface and the base line.

23. The shot cup of claim 21, wherein the impression of the at least one latent deceleration feature comprises a redirector feature at an end thereof, and wherein the redirector feature is configured for redirecting the tearing of the web at least partially away from a direction extending toward the rearward end of the sidewall of the wad.

24. The shot cup of claim 13, wherein the wad further comprises an intermediate partition between the forward portion and the rearward portion.

25. The shot cup of claim 13, wherein the sidewall of the rearward portion is a rear sidewall and the forward portion of the wad comprises a forward sidewall, and wherein the wad further comprises a series of longitudinal slits extending in the forward sidewall along a slit region of the forward portion so that the forward sidewall expands radially in the slit region after the round of ammunition is fired from the firearm for at least partially dislodging at least a portion of the payload from the forward sidewall.

26. The round of ammunition of claim 13, further comprising a region free of weakening features positioned between the rearward end of the sidewall and the at least one latent deceleration feature.

27. The round of ammunition of claim 13, wherein the at least one latent deceleration feature deploys when acted upon by gas pressure due to combustion of the propellant charge or primary compound.

28. A shot cup for small arms ammunition, the shot cup comprising:

a body including a substantially cylindrical sidewall having a forward end and at least partially defining an interior chamber for receiving a payload therein;

a series of longitudinal slits extending in the sidewall along a slit region of the sidewall so that the sidewall expands radially in the slit region after the shot cup is fired from a firearm for at least partially dislodging at least a portion of the payload from the sidewall, the series of longitudinal slits being spaced apart from the forward end of the sidewall; and a latent deceleration feature configured for deploying in response to gas pressure generated upon firing of the round of ammunition to decelerate the shot cup after the shot cup is fired from the firearm, the latent deceleration feature located substantially adjacent a rearward end of the body, spaced rearwardly from the longitudinal slits and comprising an indentation including at least one portion extending along the sidewall in a first direction and at least one portion extending along the sidewall in a second direction transverse in relation to the first direction.

29. The shot cup of claim 28, wherein at least one longitudinal slit of the series of longitudinal slits extends along a longitudinal indentation formed in a surface of the sidewall.

30. The shot cup of claim 29, wherein the longitudinal indentation comprises oblique walls extending between the surface of the sidewall and the at least one longitudinal slit.

31. The shot cup of claim 28, wherein the longitudinal slits of the series of longitudinal slits are configured for forming respective openings in the slit region of the sidewall when the sidewall expands radially in the slit region.

32. The shot cup of claim 28, wherein the body further comprises a rear cylinder portion, a forward cylinder portion, and an intermediate partition therebetween, and wherein the series of longitudinal slits is disposed in the forward cylinder portion.

33. The shot cup of claim 32, wherein the series of longitudinal slits extends proximate to the intermediate partition.

34. The shot cup of claim 32, wherein the forward cylinder portion at least partially defines the interior chamber, and the longitudinal slits of the series of longitudinal slits are in communication with the interior chamber.

35. The shot cup of claim 32, wherein the latent deceleration feature is disposed in the rear cylinder portion, and wherein the rear cylinder portion is for at least partially receiving a propellant charge.

36. The shot cup of claim 35, wherein the rear cylinder portion comprises a rear sidewall, and the latent deceleration is formed in a surface of the rear sidewall.

37. A wad or shot cup for a shotshell, comprising:

a body including a forward end, a rearward end and a substantially cylindrical sidewall defining a chamber in which a bullet or a series of pellets is received;

a plurality of longitudinal slits arranged about the sidewall, with adjacent longitudinal slits of the plurality of longitudinal slits being spaced apart from one another about the sidewall, the plurality of longitudinal slits defining a slit region spaced between the forward and rearward ends of the body, the slit region having a length and a number of slits arranged at a spacing sufficient to enable one or more portions of the sidewall to bulge radially outward after exiting a firearm barrel upon firing of the shotshell to facilitate dislodging of the bullet or one or more of the series of pellets from the chamber of the body, wherein each longitudinal slit of the plurality of longitudinal slits at least partially defines an opening that is configured to widen as the one or more portions of the sidewall bulge radially outward; and a series of petals located at the rearward end of the body and configured to flare outwardly after firing of the shotshell to an extent sufficient to cause deceleration and separation of the body from the bullet or series of pellets.

38. The wad or shot cup of claim 37, wherein the slit region is spaced from the forward end of the body by a distance of about 0.100 to about 0.200 inches.

39. The wad or shot cup of claim 37, wherein the longitudinal slits comprise a width of less than about 0.300 inches.

40. The wad or shot cup of claim 37, wherein the petals each comprise a series of indentations, impressions or weakened areas formed in the body to facilitate tearing of the body upon firing of the shotshell for forming the petals.

41. The round of ammunition of claim 37, wherein the longitudinal slits comprise a width of about 0.0005 inches to about 0.0030 inches.

* * * * *